US005453658A

United States Patent [19]

Nishino et al.

[11] Patent Number: 5,453,658

[45] Date of Patent: Sep. 26, 1995

[54] DEFLECTION YOKE

[75] Inventors: Hiroaki Nishino, Nagaokakyo; Nobuaki Miyake; Yuji Nakahara, both of Amagasaki; Yutaka Ono, Nagaokakyo, all of Japan

[73] Assignee: Mitsubishi Denki Kabushiki Kaisha, Tokyo, Japan

[21] Appl. No.: 193,993

[22] Filed: Feb. 9, 1994

[30] Foreign Application Priority Data

Feb. 15, 1993 [JP] Japan ..... 5-025386
Dec. 27, 1993 [JP] Japan ..... 5-332245

[51] Int. Cl.[6] ..... H01J 29/70

[52] U.S. Cl. ..... 313/440; 313/431; 335/213

[58] Field of Search ..... 313/440, 431; 335/210, 213, 299; 358/829

[56] References Cited

U.S. PATENT DOCUMENTS

| | | | |
|---|---|---|---|
| 3,192,432 | 6/1965 | Nero | 313/440 X |
| 4,789,806 | 12/1988 | Meershock | 313/440 |
| 5,179,319 | 1/1993 | Iwasaki et al. | 313/440 |
| 5,204,649 | 4/1993 | Togane et al. | 313/440 X |
| 5,306,982 | 4/1994 | Maillot et al. | 313/440 X |

FOREIGN PATENT DOCUMENTS

| | | |
|---|---|---|
| 147546 | 5/1992 | Japan . |
| 144042 | 5/1992 | Japan . |

*Primary Examiner*—Sandra L. O'Shea
*Assistant Examiner*—Ashok Patel

[57] ABSTRACT

A deflection yoke includes a hollow funnel-shaped tapered piece, a first set of winding hooks provided on a small-aperture portion of the tapered piece, a second set of winding hooks provided on a large-aperture portion of the tapered piece, and a deflection coil including first through n-th winding bundles. The first winding bundle includes a bundle of conductor wound onto a center winding hook at the center of the first set of winding hooks and onto the second winding hooks. The second winding bundle includes a bundle of conductor wound onto the center winding hook, the winding hooks adjacent thereto on either side, and onto the second winding hooks. The third and subsequent winding bundles include bundles of conductors wound onto the center winding hook, a plurality of winding hooks adjacent thereto on either side, and onto the second winding hooks. The first through n-th winding bundles are wound onto the first set of winding hooks in a same direction, and aligned on the first set of winding hooks. The first through n-th winding bundles are arranged in an order such that the first winding bundle is closest to an end of the small-aperture portion of the tapered piece, and the n-th bundle is farthest from the end of the small-aperture portion of the tapered piece.

22 Claims, 21 Drawing Sheets

DEFLECTION YOKE

BACKGROUND OF THE INVENTION

The present invention relates to a deflection yoke and its coil bobbin, which are disposed externally to a cathode ray tube (CRT) and which produce within the CRT a deflection magnetic field that deflects electron beams emitted by the electron gun.

Deflection yokes according to prior art have generally been made by a process in which a saddle-shaped deflection coils made by winding a conductor onto a die fit into a coil bobbin made of plastic. Ill tills case, however, it was difficult to achieve the designed winding distribution with high precision. Thus a method manufacturing a deflection coil is proposed, in which the conductor is wound directly onto a coil bobbin that is provided with guide slits (the slit-saddle winding method).

For example, FIG. 17A is a top view, FIG. 17B is a front elevation view and FIG. 17C is a bottom view of a coil bobbin according to prior art, which is capable of adopting the slit-saddle winding method. As shown in the figures, the coil bobbin 51 is provided with winding hooks 52 and 53, and has in its inner surface guide slits 54 to guide the conductor. The winding bundle of the deflection coil formed by winding the conductor onto the coil bobbin 51 is of a saddle-shape, designated by a reference numeral 55 in the lower portion of FIG. 18, and the deflection magnetic field, as shown in the upper portion of FIG. 18, has a neck side region N with a strong barrel magnetic field, a middle region M with a transition from a barrel magnetic field to a pin magnetic field, and a screen side region S with a pin magnetic field. Note that the pin magnetic field, as shown by the broken lines designated with P in the cross sectional view in FIG. 19A (taken on a plane perpendicular to the center axis AX of the coil bobbin 51), is produced when the winding bundle is present in a position close (winding angle θ of less than 30°) to the horizontal axis H passing through the center axis AX, whereas the barrel magnetic field, as shown by the broken lines designated with B in the cross sectional view in FIG. 19B (taken on a plane perpendicular to the center axis AX), is produced when the winding bundle is present in a position distant (winding angle θ of 30° to 90°) from the horizontal axis H.

For example, Japanese Patent Kokai Publications 14402/1992 and 147546/1992 disclose a proposal shown in FIGS. 20A and 20B, in which a virtually hollow funnel-shaped coil bobbin 61 is provided with winding hooks 62 in multiple tiers. FIG. 20A is a front elevation view and FIG. 20B is a perspective view of the coil bobbin. The winding bundle 63 of the deflection coil wound onto the coil bobbin 61 is of a saddle-shape, as shown in the lower portion of FIG. 21, and the deflection magnetic field, as shown in the upper portion of FIG. 21, has a neck side region N with a strong barrel magnetic field, a middle region M with a transition from a barrel magnetic field to a pin magnetic field, and a screen side region S with a pin magnetic field.

Nevertheless, in a deflection yoke using the coil bobbin 51 shown In FIGS. 17A, 178 and 17C, a problem arises in that, since all conductor turns are wound within the flange 56 of the coil bobbin 51 so that they overlap, the degree of projection outside the winding bundle 55 (designated in FIG. 18 by a reference numeral 55*a*) increases and the diameter of the annular core (not shown) on the outside of the winding bundle 55 is increased. Thus the deflection magnetic field cannot be produced efficiently, and deflection sensitivity is reduced.

In the deflection yoke shown in FIGS. 20A and 20B, despite the adoption of a multiple-tier structure for the flange which reduces the degree of projection of the winding bundle 63 at the bridging portion 64, the problem arises in that, since flanges 62*a* of winding hooks 62 protrude outside the coil bobbin 61, the diameter of the annular core mounted outside the winding bundles 63 is large. Thus, the deflection field cannot be produced efficiently, and deflection sensitivity is reduced.

This reduction in deflection sensitivity is a particularly serious problem in television sets with a wide deflection angle, high-definition television (HDTV) and the like.

In deflecting the beam from an in-line electron gun, a further problem inverse-cross misconvergence arises with both of the deflection yokes shown in FIGS. 17A to 17C and FIGS. 20A and 20B. This is a phenomenon, whereby, the position irradiated by the blue beam is skewed as shown by broken lines in FIG. 22 and the position irradiated by the red beams is skewed as shown by solid lines in FIG. 22. Each of the positions irradiated is skewed in reverse directions with each other and in directions that are reversed at the center and the periphery of the screen.

This inverse-cross misconvergence occurs in cases when, as shown in FIG. 18 and FIG. 21, the barrel magnetic field in the neck side region N is strong, the barrel magnetic field in the middle region M is weak, and the pin magnetic field in the screen side region S is weak. It is therefore possible to reduce the inverse-cross misconvergence if the barrel magnetic field in the neck side region N can be weakened, the barrel magnetic field in the middle region M, which has a major influence on the central portion of the CRT screen, can be strengthened, and the pin magnetic field in the screen side region S, which has a major influence on convergence at the periphery of the CRT screen can be strengthened. With the coil bobbins shown in FIG. 18 and FIG. 21, however, it is impossible to make a deflection yoke capable of producing such deflection magnetic fields. And with the deflection yoke shown in FIG. 20 specifically, the inverse-cross misconvergence is particularly large since the winding bundle (designated by a reference numeral 64) that produces the barrel magnetic field is disposed up to the end of the neck side region N.

SUMMARY OF THE INVENTION

It is an object of the present invention to provide a deflection yoke and its coil bobbin that can both raise deflection sensitivity and be manufactured easily by the unitary slit saddle winding method.

It is another object of the present invention to provide a deflection yoke and its coil bobbin that will produce a deflection magnetic field such that inverse-cross misconvergence is reduced and a high-quality image can be obtained.

According to one aspect of the present invention, a coil bobbin for a deflection yoke comprises a hollow funnel-shaped tapered piece having a small-aperture portion and a large-aperture portion, a plurality of first winding hooks provided at the small-aperture portion of the tapered piece, and a plurality of second winding hooks provided at the large-aperture portion of the tapered piece. The first winding hooks protrude in a direction parallel to a center axis of the tapered piece, while outermost surfaces of the first winding hooks are positioned inward from an inner surface of the small-aperture portion. This prevents the protrusion of the winding bundle wound onto the first winding hooks at the small-aperture portion of the tapered piece to the outside, and facilitates the mounting of an annular core further to the outside of the winding bundle. Further, the inner diameter of the annular core can be reduced, making possible an increase in deflection sensitivity. In addition, the use of tills coil bobbin causes the first winding hooks to protrude in a direction parallel with the center axis of the tapered piece, with the effect that a larger number of conductor turns can be wound from the base to the tip of the first winding hook, producing a stronger deflection magnetic field.

According to another aspect of the present invention, an inner angle at tips of each of the first winding hooks is chamfered to form a curved surface. This facilitates the winding operation by means of a winding machine, for example, and eliminates the danger that the conductor may be damaged by catching on the tip of the first winding hook.

According to still another aspect of the present invention, each of the first winding hooks is thicker toward the tapered piece and thinner toward the tip. This eliminates the damage to the first winding hooks during insertion of the CRT neck into the tapered piece. It has the further effect, since the first winding hooks become progressively thinner toward the tips, of facilitating the operation of threading the conductor by means of a winding machine, for example, and reducing the danger of damage to the conductor.

According to the further aspect of the present invention a coil bobbin comprises a concavity recessed toward the large-aperture portion, formed at the small-aperture portion of the tapered piece and positioned at a place separated from the winding hooks provided at the center. Due to the provision of a concavity at a position separated from the central winding hook and at the end of the small-aperture portion of the tapered piece, makes it possible to change the position at which the conductor to be wound onto the coil bobbin is threaded and thus has the effect of optimizing the distribution of the deflection field.

According to the still further aspect of the present invention, a coil bobbin comprises an annular piece of thin sheet having the same planar shape as the small-aperture portion and provided at the small-aperture portion. Due to the provision at the small-aperture portion of the tapered piece of a thin annular piece having the same planar shape as the small-aperture portion, makes it possible to use the same coil bobbin even for CRTs of different sizes. This makes possible the standardization of the coil bobbin and, by reducing the expense of manufacturing the dies used to mold the coil bobbin, has the effect of reducing the cost of manufacturing the deflection yoke.

According to the still further aspect of the present invention, a coil bobbin further comprises a winding guide of virtually cylindrical shape for guiding a conductor wound onto the first winding looks, the winding guide being provided on the outside of the first winding hooks. Due to the provision on the outside of the first winding hooks of a winding guide of virtually cylindrical shape that guides the conductor wound onto the first winding hooks, makes it possible to prevent the external projection of the winding bundle wound onto the coil bobbin and thus has the effect of facilitating the mounting of the annular core. Further the inner diameter of the annular core can be reduced, having the effect of improving the deflection sensitivity.

According to the still further aspect of the present invention, the winding guide is lower than the first winding hooks. Since the tip of the winding guide is positioned lower than the tips of the first winding hooks, has the effect of facilitating the operation of winding the conductor by means of a winding machine, for example, when a conductor drawn out from the inside of the coil bobbin toward the small-aperture side is threaded onto the first winding hooks of the coil bobbin by hook pieces on the outside of the coil bobbin, improving the ease with which windings are wound and thereby improving reflection yoke productivity.

According to the still another aspect of the present invention, a tip of the winding guide is of an arcuate shape that is high at the point opposite to the winding guide at the center of the first winding guides and lower toward both ends. Since the tip of the winding guide is of an arcuate shape that is high at the point opposite to the winding hook at the center of the first winding hooks and becomes lower toward both ends, has the effect of facilitating the operation of winding the conductor by means of a winding machine, for example, in which a conductor drawn out from the inside of the coil bobbin toward the small-aperture portion is threaded onto the first winding hooks of the coil bobbin by hook pieces on the outside of the coil bobbin, and, by improving the ease with which windings are wound, improving deflection yoke productivity. Further, even if the winding machine is such that the conductor first is threaded onto one of the first winding hooks and then slides to its base, the conductor can, at the lower positions on the winding guide, be threaded at a position near the base of the first winding hook, so that the distance that the conductor slides over the first winding hook 2 or 3 is shortened, with the effect that damage to the conductor is reduced. In addition, if the tip of the winding guide is of an arcuate shape, with the effect of preventing the damage that may occur to the conductor when it strikes against the tip of the winding guide.

According to another aspect of the present invention, a deflection yoke comprises a hollow funnel-shaped tapered piece having a small-aperture portion and a large-aperture portion, a plurality of first winding hooks provided on the small-aperture portion of the tapered piece, a plurality of second winding hooks provided on the large-aperture portion of the tapered piece, and a deflection coil for producing a magnetic field for deflecting an electron beam which is emitted from an in-line gun of a CRT and proceeds within the tapered piece from the small-aperture portion to the large-aperture portion, the deflection coil comprising a bundle of conductor wound onto the first and second winding hooks and disposed along an inner surface of the tapered piece. The first winding hooks protrude in a direction parallel to that of a center axis of the tapered piece. The deflection coil comprises first through n-th winding bundles (where n is a positive integer equal to or greater than 2). The first winding bundle comprises a bundle of conductor wound for a specific number of turns onto the winding hook at the center of the first winding hooks and the second winding hooks, the second winding bundle comprises a bundle of conductor wound for a specific number of turns onto the winding hook at the center of the first winding hooks and the winding hoods adjacent thereto on either side, and the second winding hooks, and the third and subsequent winding bundles comprise bundles of conductor wound for a specific number of turns onto the winding hook at the center of the first winding hooks and a plurality of winding hoods adjacent thereto on either side, and the second winding hooks. The direction in which the first through n-th winding bundles are wound onto the first winding hooks is identical, aligned oil the first winding hooks, and arranged in an order such that the first winding bundle is on the innermost side and the n-th bundle is on the outer side, and further that the winding bundle on the outside is aligned along the winding bundle adjacent thereto on the inner side. Since the direction in which the first through n-th winding bundles are wound onto the first winding hooks is identical, they are aligned on the first winding hooks, and they are arranged in an order such that the first winding bundle is on the innermost side and the n-th bundle is on the outermost side, and further since the winding bundle on the outside is aligned along the winding bundle adjacent to it on the inner side, and further since the first through n-th winding bundles are thus arranged so that they are aligned along the first winding hooks, they are therefore formed in such a way that the winding bundle does not protrude to the outside at the bridging portion of the winding bundle, thereby facilitating the mounting of the annular core on the outside. Further, since the first winding hooks protrude in a direction parallel to the center axis of the tapered piece, has the effect that more winding turns can be wound onto the first winding hooks from base to tip so that a stronger deflection magnetic field can be produced. Further, since the first winding bundle is arranged in an order such that it is on the innermost side and the n-th bundle is on the outermost side, and further since the winding bundle on the outside is aligned along the winding bundle adjacent to it on the inner side, a winding bundle is provided that acts to weaken the barrel magnetic field in the neck side region of the deflection yoke (the neck side when mounted to a CRT), thereby weakening the barrel magnetic Field at the neck region of the deflection yoke with the effect of reducing inverse-cross misconvergence.

According to the further aspect of the present invention, when the deflection yoke is mounted to the CRT, the first through n-th winding hooks are provided in pairs that face each other from above and below the tapered piece. Since, when the deflection yoke is mounted to a CRT, the first through n-th winding hooks are provided in pairs that Face each other from above and below the tapered piece, the deflection magnetic field produced by the deflection yoke is symmetrical above and below, so that a suitably horizontal deflection field can be produced.

According to the still further aspect of the present invention, the first through n-th winding bundles arranged along the inner surface of the tapered piece are bent at a specific point between the small-aperture portion and the large-aperture portion so that magnetic field produced on the small-aperture portion side of the bend is mainly a barrel magnetic field, and magnetic Field produced on the large-aperture portion side of the bend is mainly a pin magnetic field. Since the first through n-th winding bundles arranged along the inner surface of the tapered piece are bent at a specific point between the small-aperture portion and the large-aperture portion, the misconvergence at the center of the screen is reduced by means of the barrel magnetic field produced on the small-aperture portion side of the bend, and the misconvergence at the periphery of the screen is reduced by means of the pin magnetic field produced on the large-aperture portion side of the bend.

According to the still Further aspect of the present invention, when the deflection yoke is mounted to the CRT, the first through n-th winding bundles are so arranged that the winding angle formed between the lines connecting the center axis of the tapered piece and the upper or lower ends of the winding coils to the horizontal plane is increased at the small-aperture portion side of the bend in the deflection coil, and the winding angle is decreased at the large-aperture portion side of the bend in the deflection coil. When the deflection yoke is mounted to a CRT, the winding angle at the small-aperture portion side of the bend in the deflection coil is increased, thereby strengthening the barrel magnetic field and reducing misconvergence at the center of the screen. Further since the winding angle at the large-aperture portion side of the bend in the deflection coil is decreased, the pin magnetic field is strengthened and misconvergence at the periphery of the screen is reduced.

According to the further aspect of the present invention, the first through n-th winding bundles are so arranged that the winding bundles with a winding angle greater than 30° are more numerous at the small-aperture portion side of the bend in the deflection coil, and the winding bundles with a winding angle less than 30° are more numerous at the large-aperture portion side of the bend. Since the winding bundles in a position such that the winding angle is greater than 30° are more numerous at the small-aperture portion side of the bend in the deflection coil, the barrel magnetic field is strengthened and misconvergence at the center of the screen is reduced, and, since the the winding bundles such that the winding angle is less than 30° are more numerous at the large-aperture side of the bend, the pin magnetic field is strengthened and misconvergence at the periphery of the screen is reduced.

According to the still further aspect of the present invention, a deflection yoke further comprises third winding hooks disposed on the inner surface of the tapered piece near the midpoint between the small-aperture portion and the large-aperture portion, and a first folded winding bundle wound on the first winding hooks and the third winding hooks in the same direction as the first through n-th winding bundles. The use of this deflection yoke, due to the further provision of third winding hooks on the inner surface of the tapered piece near the midpoint between the small-aperture portion and the large-aperture portion, and of a first folded winding bundle that is wound on the first and third winding hooks in the same direction as the first through n-th winding bundles, has the effect of strengthening the barrel magnetic field in the position at the neck side of the deflection yore and further reducing misconvergence at the center of the screen.

According to the still further aspect of the present invention a deflection yoke further comprises fourth winding hooks disposed on the inner surface of the tapered piece near the midpoint between the small-aperture portion and the large-aperture portion, and a first reverse-wound winding bundle wound on the second winding hooks and the fourth winding hooks in the direction opposite to that of the first through n-th winding bundles. The use of this deflection yoke, due to the further provision of fourth winding hooks on the inner surface of the tapered piece near the midpoint between the small-aperture portion and the large-aperture portion, and of the first reverse-wound winding bundle that is wound on the second and fourth winding hooks in the direction opposite to that of the first through n-th winding bundles, has the effect of strengthening the pin magnetic field on the screen side of the deflection yoke and reducing misconvergence at the periphery of the screen.

According to the still further aspect of the present invention, the first reverse-wound winding bundle includes a second reverse-wound winding bundle that is wound onto the winding hook at the center of the second winding hooks and onto the fourth winding hooks, and a third reverse-wound winding bundle that is wound onto the winding hook at the center of the second winding looks and the winding hooks adjacent thereto and onto the fourth winding hooks. The use of this deflection yoke, since the first reverse-wound winding bundle has a plurality of reverse-wound winding bundles, has the effect of further strengthening the pin field on the screen slide of the deflection yoke and further reducing misconvergence at the periphery of the screen.

According to the still further aspect of the present invention, when the deflection yoke is mounted to the CRT, the first reverse-wound winding bundle is arranged in such a way that the winding angle formed between the lines connecting the center axis of the tapered piece and the upper or lower ends of the winding coils to the horizontal plane is greater than 30°. The use of this deflection yoke, when the deflection yoke is mounted to a CRT, since the first reverse-wound winding bundle is arranged in such a way that the winding angle is greater than 30°, has the effect of strengthening the pin magnetic field on the screen side of the deflection yoke and reducing misconvergence at the periphery of the screen.

According to the still further aspect of the present invention, a deflection yoke further comprises fifth winding hooks disposed oil the inner surface of the tapered piece near the midpoint between the small-aperture portion and the large-aperture portion, a second folded winding bundle wound onto the first winding hooks and the fifth winding hooks in the same direction as the first through n-th winding bundles, sixth winding hooks disposed on the inner surface of the tapered piece nearer the large-aperture portion than the fifth winding hooks, and a fourth reverse-wound winding bundle wound onto the second winding hooks and the sixth winding hooks in the direction opposite to the first through n-th winding bundles. A conductor wound in the same direction as the first through n-th winding bundles onto the first winding hooks and the fifth winding hooks is led to the sixth winding hooks and wound in the direction opposite to the first through n-th winding bundles onto the sixth winding hooks and the second winding hooks, thereby forming a second folded winding bundle and fourth reverse-wound winding bundle in the shape of an approximate figure of eight with intersections between the fifth winding hooks and the sixth winding hooks. The use of this deflection yoke, has the effect, by means of the second folded winding bundle, of strengthening the barrel magnetic field and further reducing misconvergence at the center of the screen, and by means of the fourth reverse-wound winding bundle, of strengthening the pin field and reducing misconvergence at the periphery of the screen.

According t,o the still further aspect of time present invention, when the deflection yoke is mounted to the CRT, the fourth reverse-wound winding bundle is arranged in such a way that the winding angle formed between the lines connecting the center axis of the tapered piece and the upper or lower ends of the winding coils to time horizontal plane is greater than 30°. The use of this deflection yoke, when the deflection yoke is mounted to a CRT, since the fourth reverse-wound winding bundle is arranged in such a way that the winding angle is greater than 30°, has the effect of strengthening the pin magnetic field and reducing misconvergence at the periphery of the screen.

DETAILED DESCRIPTION OF THE INVENTION

Following is a description of deflection yokes and coil bobbins according to the present invention based on the accompanying drawings.

First Embodiment

Figure 1:
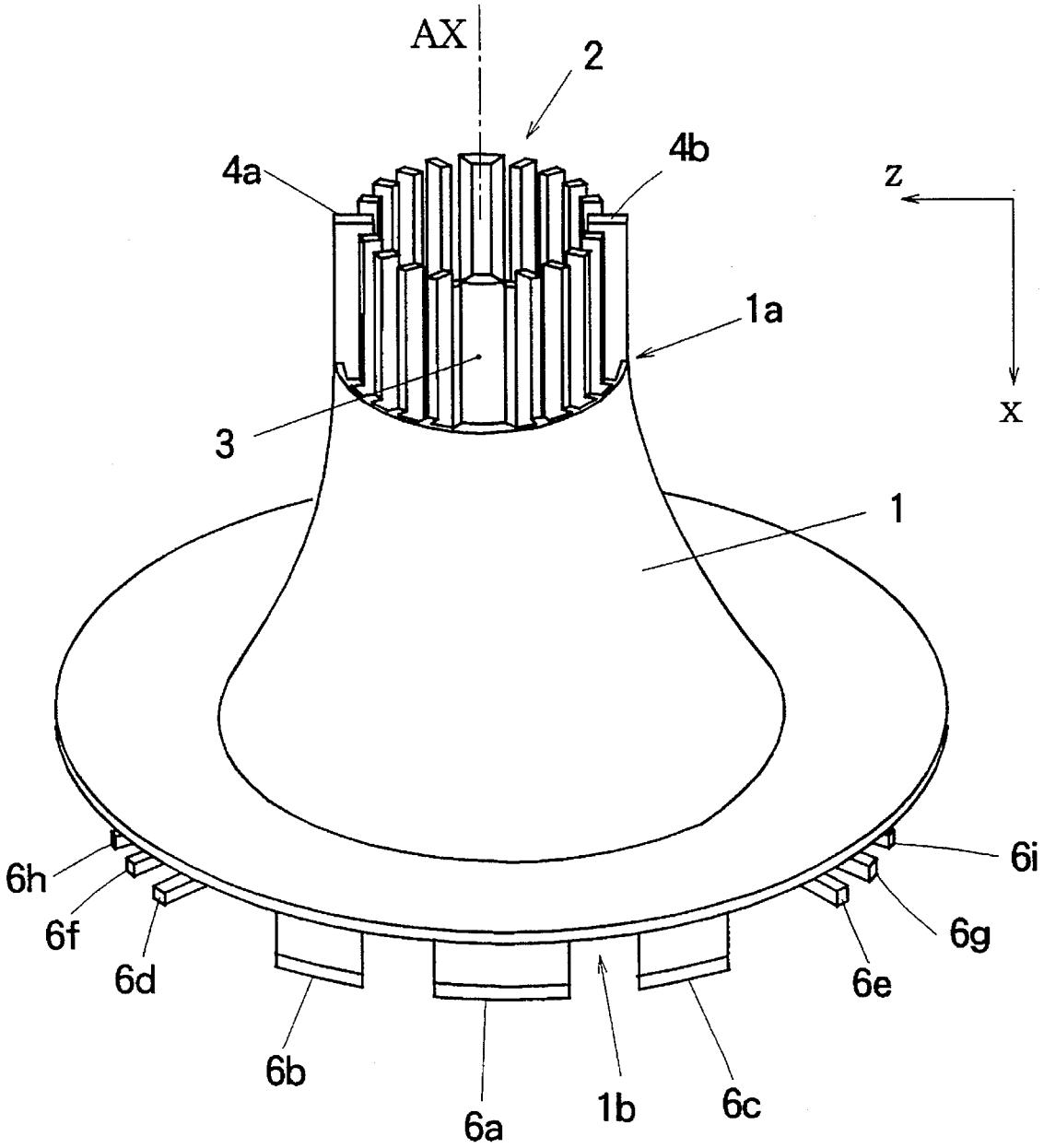
FIG. 1 is a perspective view showing a coil bobbin of a deflection yoke according to a first embodiment of the present invention.
Figure 2:
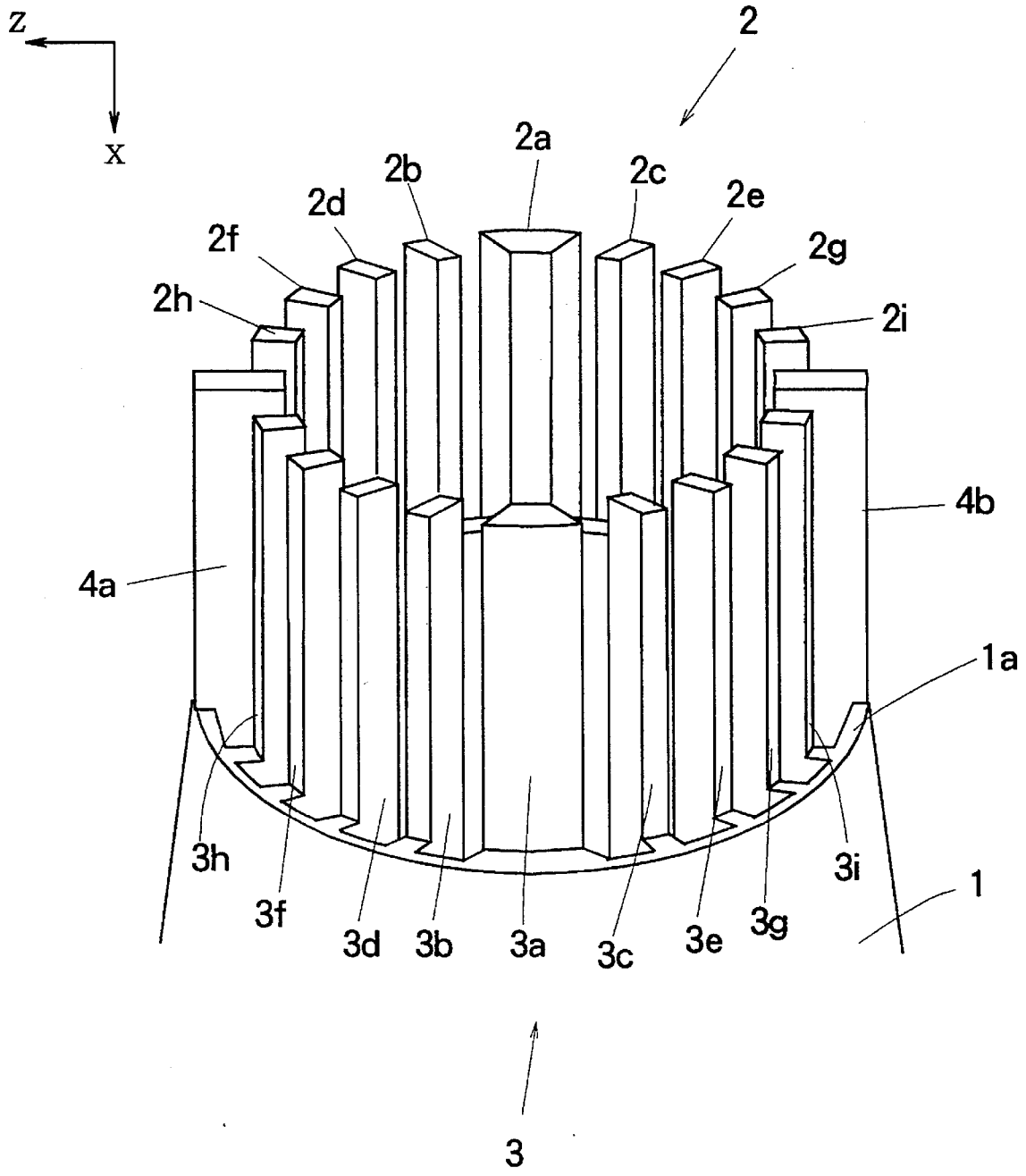
FIG. 2 is an enlarged perspective view showing a small-aperture portion of the coil bobbin or the deflection yoke according to the first embodiment.
Figure 3:
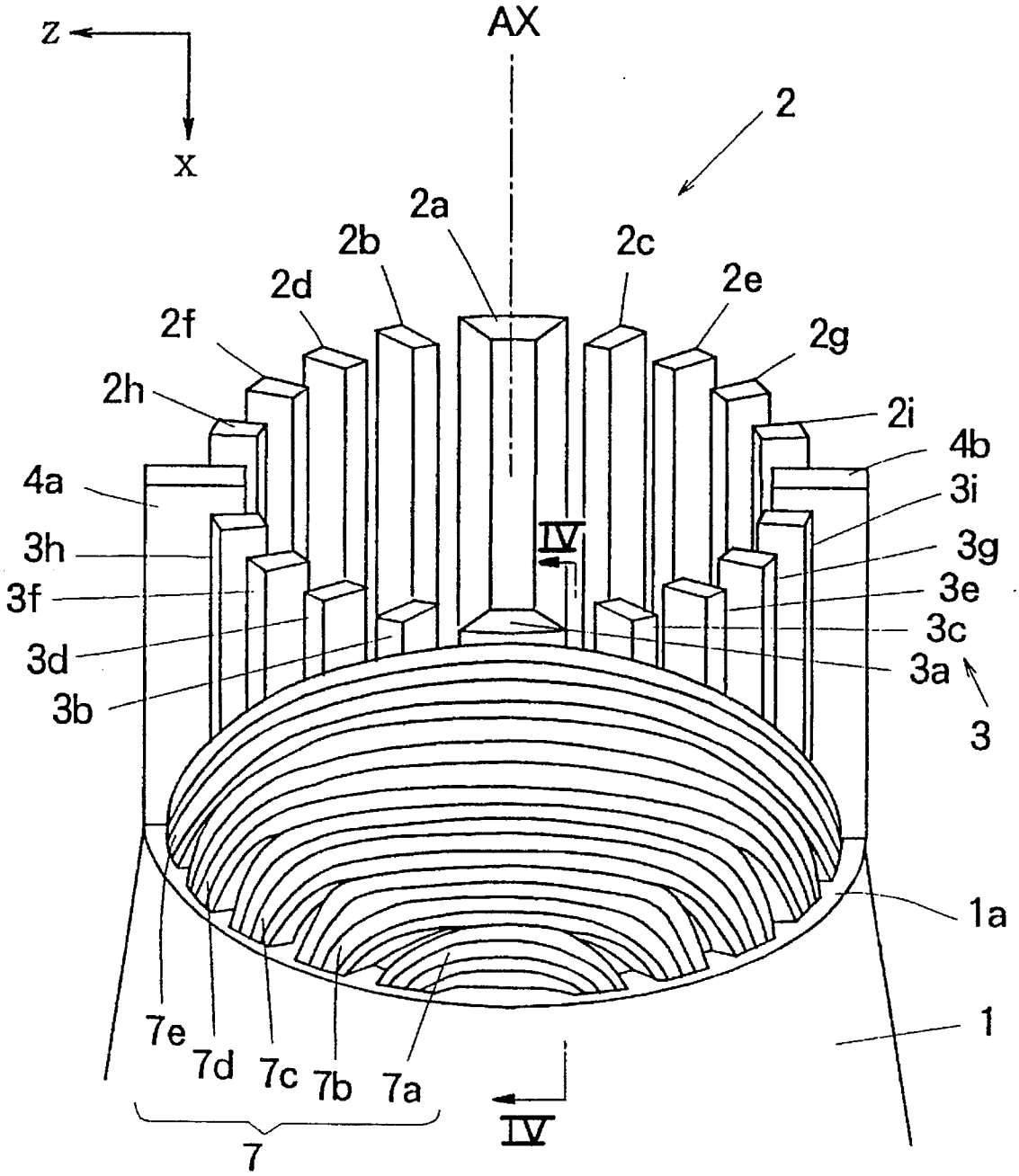
FIG. 3 is an enlarged perspective view showing the small-aperture portion of the coil bobbin of the deflection yoke according to the first embodiment when the coil bobbin is provided with a deflection coil.
Figure 4:
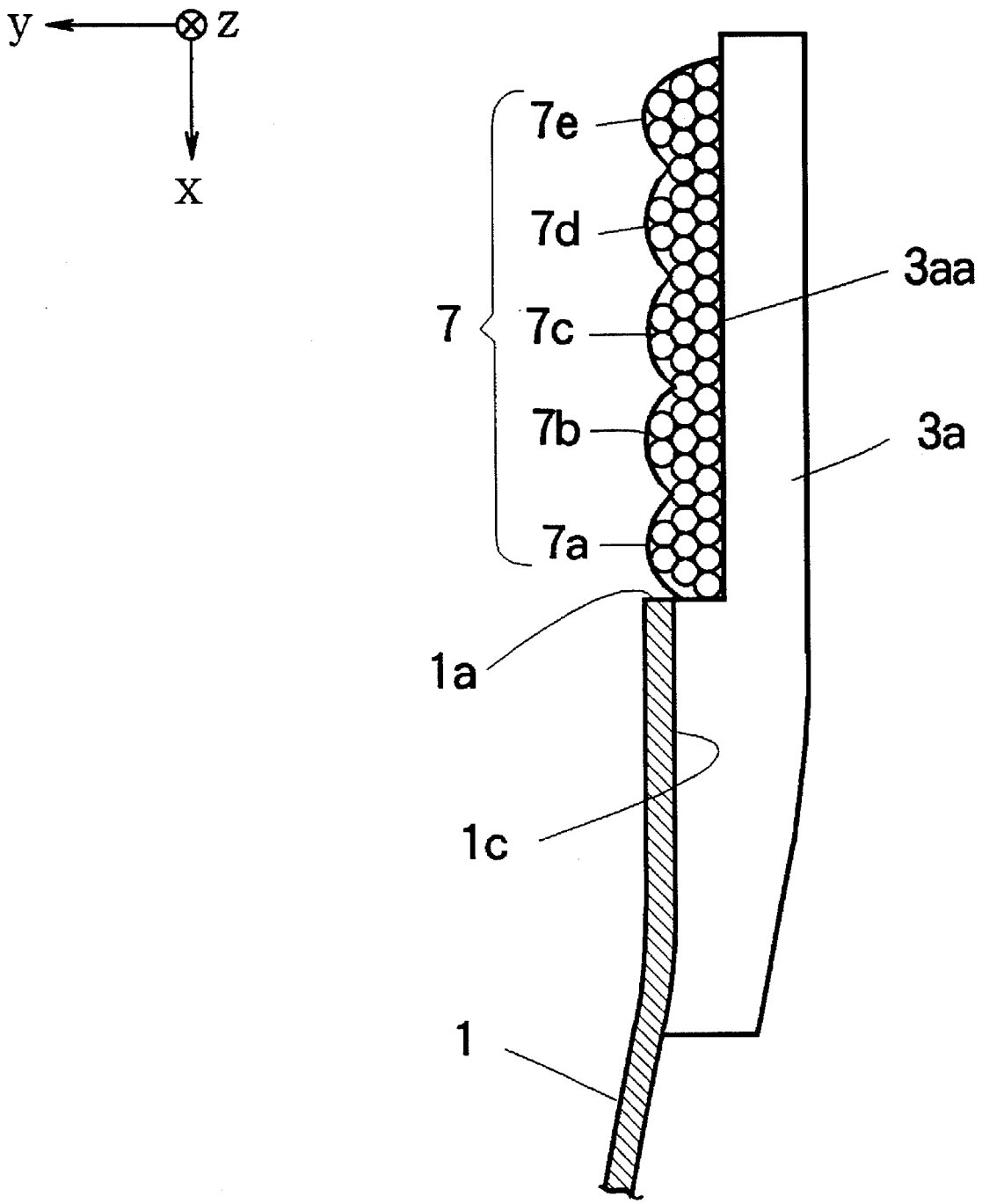
FIG. 4 is a cross sectional view taken on line IV—IV in FIG. 3.
Figure 5:
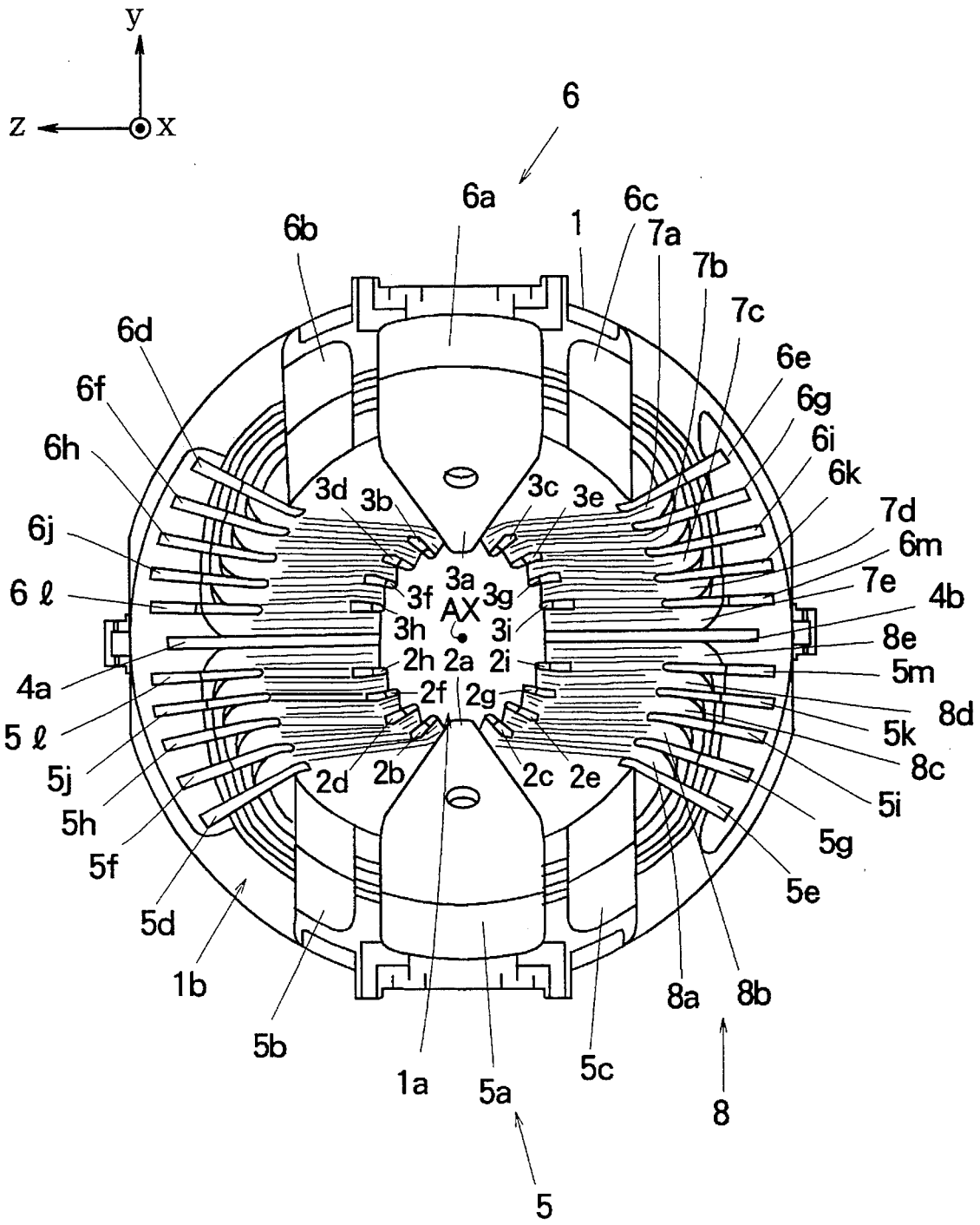
FIG. 5 is a view showing a large-aperture portion of the deflection yoke (shown at the bottom of FIG. 1) according to the first embodiment.
Figure 6:
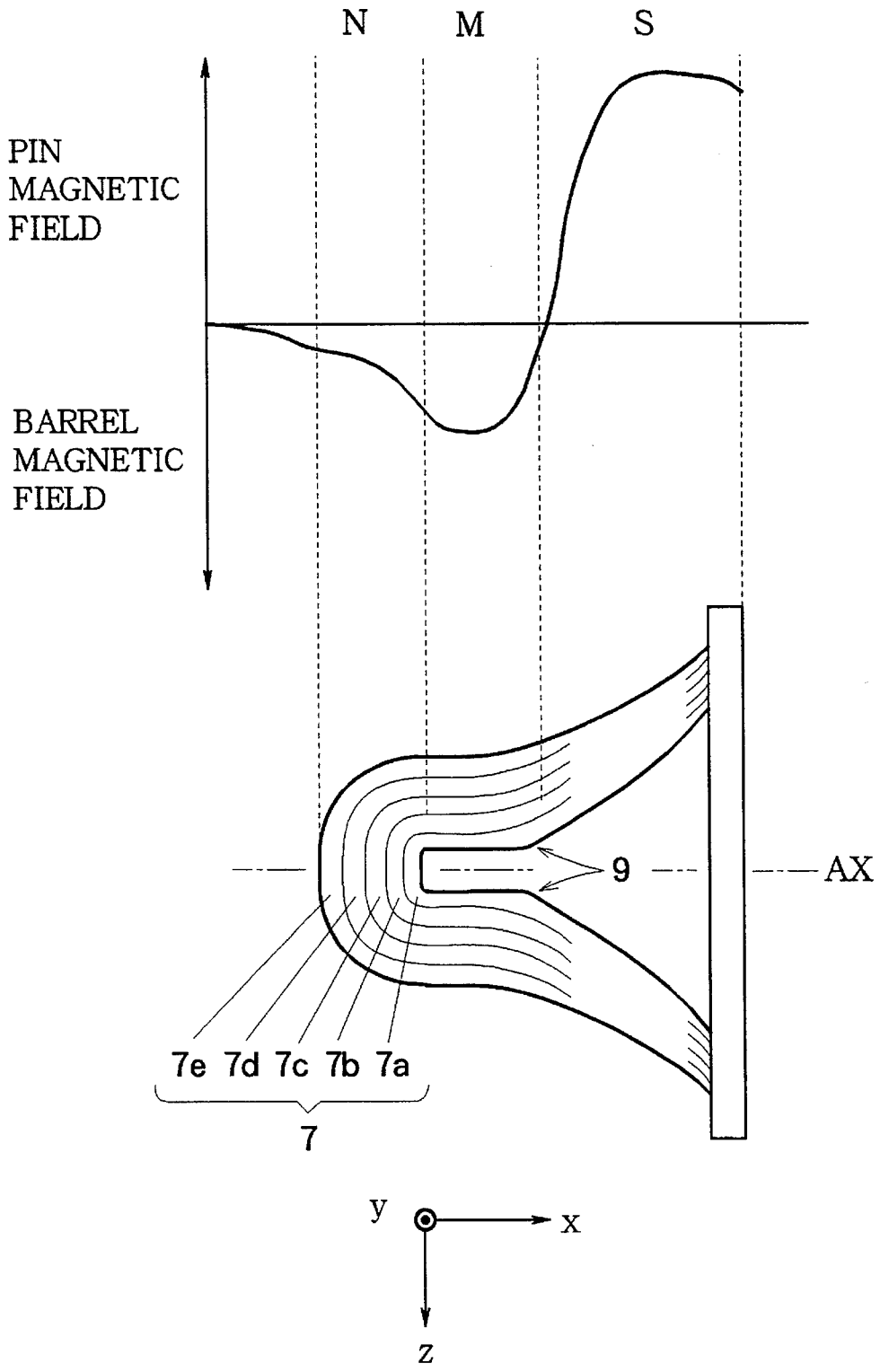
FIG. 6 shows, in its lower portion, a plane view from above the deflection coil showing its condition when the deflection yoke is mounted to a CRT, and, in its upper portion, an explanatory drawing showing the deflection magnetic field produced by the deflection coil.

FIG. 1 through FIG. 6 are drawings describing a deflection yoke (which here is a horizontal deflection yoke) and a coil bobbin that forms part of the deflection yoke according to a first embodiment of the present invention. FIG. 1 is a perspective view showing the coil bobbin consisting of a tapered piece 1 and winding hooks; FIG. 2 is an enlarged perspective view showing the small-aperture portion 1*a* of the coil bobbin; FIG. 3 is an enlarged perspective view showing the small-aperture portion 1*a* of the coil bobbin of a deflection yoke; FIG. 4 is a cross sectional view taken on line IV—IV in FIG. 3; FIG. 5 is a bottom view showing the deflection yoke from the large-aperture portion 1*b* of the tapered piece 1 (the bottom of FIG. 1); and FIG. 6 shows, in its lower portion, a plane view from above the deflection coil 7 when the deflection yoke is mounted to a cathode ray tube (CRT), and, in its upper portion, all explanatory drawing showing the deflection field produced by the deflection coil. In the drawings, AX designates the center axis of the tapered piece 1 having a nearly funnel shape; x, y and z designate, respectively, the horizontal forward direction (the direction of the image-display surface of the CRT, which is parallel to the center axis AX), the vertical upward direction and the horizontal transverse direction. In FIG. 4, the z direction designates a direction perpendicular to the surface of the drawing sheet and facing from its obverse to its reverse surface, and in FIG. 5, the x direction designates a direction perpendicular to the surface of the drawing sheet and facing from its reverse to its obverse surface.

As is shown in FIG. 1, a deflection yoke according to the first embodiment comprises the tapered piece 1 of virtually hollow funnel shape; a plurality of winding hooks 2 and 3 provided on the small-aperture portion 1*a* of the tapered piece 1 (which are designated collectively by reference numerals 2 and 3 and individually by reference numerals 2*a* through 21 and 3*a* through 3*i*); and a plurality of winding hooks 5 and 6 provided on the large-aperture portion 1*b* of the tapered piece 1 (which are designated collectively by reference numerals 5 and 6 and individually by reference numerals 5*a* through 5*i* and 6*a* through 6*i*). The coil bobbin, on which the conductor of the deflection yoke is wound, comprises the tapered piece 1, winding hooks 2 and 3, and winding hooks 5 and 6. The coil bobbin is formed from insulating material such as plastic.

As is shown in FIG. 1 through FIG. 3 and FIG. 5, a deflection yoke according to the first embodiment has a pair of separating plates 4*a* and 5*b*, which are provided on the inner surface of the tapered piece 1 in a position that is centered symmetrically on the center axis AX. When the deflection yoke is mounted to a CRT, these separating plates 4*a* and 5*b* are lined up horizontally (left to right as viewed from the front surface of the CRT), and the winding hooks 2 and 3 are divided vertically into two groups.

The deflection yoke according to the first embodiment also has deflection coils 7 and 8. The deflection coil 7 consists of winding bundles 7*a* through 7*e*, which are wound on the winding hooks 3, wound over the inner surface of the tapered piece 1 and the winding hooks 6, while the deflection coil 8 consists of winding bundles 8*a* through 8*e*, which are wound onto the winding hooks 2, wound over the inner surface of the tapered piece 1 and onto the winding hooks 5. The deflection coil 7 and deflection coil 8 are disposed symmetrically, centered on a plane that includes the center axis AX of the tapered piece 1 and the separating plates 4*a* and 5*b*.

As is shown in FIG. 4, the winding hook 3*a* protrudes from the small-aperture portion of the tapered piece 1 in a direction parallel with the center axis AX, and the outer surface 3*a* a of the winding hook 3*a* is structured in such a way that it is inside the inner surface of the tapered piece 1 (the direction opposite to the direction y in FIG. 4). Similarly, the other winding hooks 3*b* through 3*i* and 2*a* through 2*i* protrude from the small-aperture portion of the tapered piece 1 in a direction parallel with the center axis AX, and the outer surfaces of the other winding hooks 3*b* through 3*i* and 2*a* through 2*i* are structured in such a way that they are inside the inner surface of the tapered piece 1.

And, as is shown in FIG. 3, FIG. 5 and FIG. 6, the conductor forming a winding bundle 7*a* of the deflection coil 7 is wound a specific number of turns in the same direction onto the winding hook 3*a*, which is the thickest of all the winding hooks and the farthest separated from the separating plates 4*a* and 5*b*, over the inner surface 1*c* of the tapered piece 1, and onto the winding hooks 6*e*, 6*c*, 6*a*, 6*b* and 6*d* on the large-aperture portion 1*b*. After winding bundle 7*a*, the conductor forming a winding bundle 7*b* is wound a specific number of turns in the same direction onto the three winding hooks 3*b*, 3*a* and 3*e*, which include the adjacent winding hooks 3*b* and 3*e*, and over the inner surface 1*c* of the tapered piece 1, and onto the winding hooks 6*g*, 6*e*, 6*c*, 6*a*, 6*b*, 6*d* and 6*f* on the large-aperture portion 1*b*. Thereafter, the conductor forming a winding bundle 7*e* is wound a specific number of turns in the same direction onto the five winding hooks 3*d*, 3*b*, 3*a*, 3*c*, and 3*e*, which include the next adjacent winding hooks 3*d* and 3*e*, over the inner surface 1*c* of the tapered piece 1, and onto the winding hooks 6*i*, 6*g*, 6*e*, 6*c*, 6*a*, 6*b*, 6*d*, 6*f* and 6*h* on the large-aperture portion 1*b*. Thereafter, the conductor forming a winding bundle 7*d* is wound a specific number of turns in the same direction onto the seven winding hooks 3*f*, 3*d*, 3*b*, 3*a*, 3*c*, 3*e* and 3*g*, which include the next adjacent winding hooks 3*f* and 3*g*, over the inner surface 1*e* of the tapered piece 1, and onto the winding hooks 6*k*, 6*i*, 6*g*, 6*e*, 6*c*, 6*a*, 6*b*, 6*d*, 6*f*, 6*h* and 6*j* on the large-aperture portion 1*b*. Thereafter, the conductor forming a winding bundle 7*e* is wound a specific number of turns in the same direction onto the nine winding hooks 3*h*, 3*f*, 3*d*, 3*b*, 3*a*, 3*c*, 3*e*, 3*g*, and 3*i*, which include the next adjacent winding hooks 3*h* and 3*i*, and over the inner surface 1*c* of the tapered piece 1, and onto winding hooks 6*m*, 6*k*, 6*i*, 6*g*, 6*e*, 6*c*, 6*a*, 6*b*, 6*d*, 6*f*, 6*h*, 6*j* and 6*l* on the large-aperture portion 1*b*.

Similarly, the conductor forming a winding bundle 8*a* of the deflection coil 8 is wound a specific number of turns in the same direction onto the winding hook 2*a*, which is the thickest of all the winding hooks and the farthest separated from the separating plates 4*a* and 4*b*, on the inner surface 1*c* of the tapered piece 1, and onto the winding hooks 5*e*, 5*c*, 5*a*, 5*b* and 5*d* on the large-aperture portion 1*b*. After winding bundle 8*a*, the conductor forming a winding bundle 8*b* is wound a specific number of turns in the same direction onto the three winding hooks 2*b*, 2*a* and 2*c*, which include the adjacent winding hooks 2*b* and 2*c*, on the inner surface 1*c* of the tapered piece 1, and onto winding hooks 5*g*, 5*e*, c, 5*a*, 5*b*, 5*d* and 5*f* on the large-aperture portion 1*b*. Thereafter, the conductor forming a winding bundle 8*c* is wound a specific number of turns in the same direction onto the five winding hooks 2*d*, 2*b*, 2*a*, 2*c*, and 2*e*, which include the next adjacent winding hooks 2*d* and 2*e*, on the inner surface 1*c* of the tapered piece 1, and onto the winding hooks 5*i*, 5*g*, 5*e*, 5*c*, 5*a*, 5*b*, 5*d*, 5*f* and 5*h* on the large-aperture portion 1*b*. Thereafter, the conductor forming a winding bundle 8*d* is wound a specific number of turns in the same direction onto the seven winding hooks 2*f*, 2*d*, 2*b*, 2*a*, 2*c*, 2*e* and 2*g*, which include the next adjacent winding hooks 2*f* and 2*g*, on the inner surface 1*c* of the tapered piece 1, and onto winding hooks 5*k*, 5*i*, 5*g*, 5*e*, 5*c*, 5*a*, 5*b*, 5*d*, 5*f*, 5*h* and 5*j* on the large-aperture portion 1*b*. Thereafter, the conductor forming a winding bundle 8*e* is wound a specific number of turns in the same direction onto the nine winding hooks 2*h*, 2*f*, 2*d*, 2*b*, 2*a*, 2*c*, 2*e*, 2*g*, and 21, which include the next adjacent winding hooks 2*h* and 2*i*, on the inner surface 1*c* of the tapered piece 1, and onto winding hooks 5*m*, 5*k*, 5*i*, 5*g*, 5*e*, 5*c*, 5*a*, 5*b*, 5*d*, 5*f*, 5*h*, 5*j* and 51 on the large-aperture portion 1*b*.

When the conductor that constitutes the deflection coil 7 is wound onto the tapered piece 1, as shown in FIG. 3, FIG. 4 and FIG. 6, it is wound in such a way that, at the bridging portion on the winding hooks 3 on the small-aperture portion in of the tapered piece 1, the winding bundles 7*a* through 7*e* do not overlap in the radial direction of the tapered piece 1 (the direction y in FIG. 4). The winding bundles 7*a* through 7*e* are aligned along the winding hooks 3, and the outer winding bundle is aligned with the inner winding bundle. Similarly, when the conductor that constitutes the deflection coil 7 is wound onto the tapered piece 1, it is wound in such a way that, at the bridging portion on the winding hooks 2 on the small-aperture portion 1*a* of the tapered piece 1, the winding bundles 8*a* through 8*e* do not overlap in the radial direction of the tapered piece 1. The winding bundles 8*a* through 8*e* are aligned along the winding hooks 3, and the outer winding bundle is aligned with the inner winding bundle.

Figure 19A:
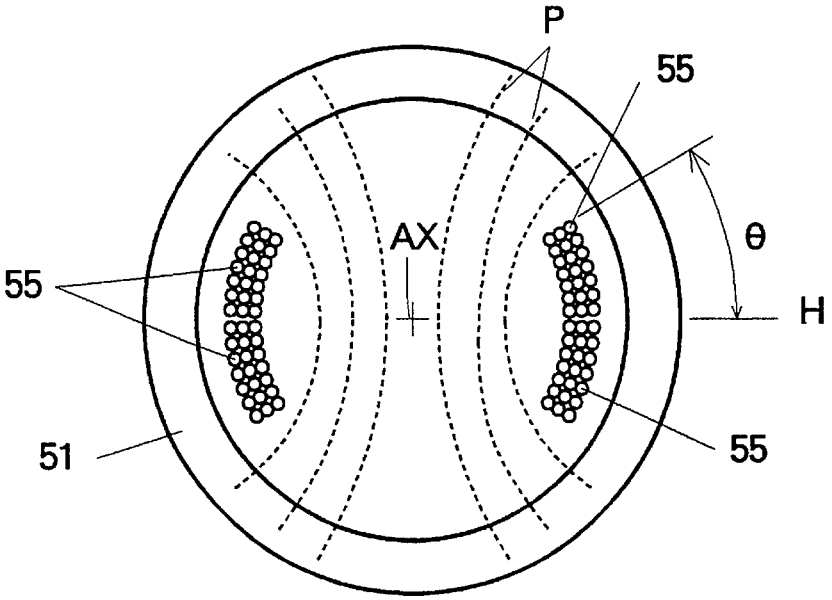
FIG. 19A is an explanatory drawing showing a pin magnetic field.
Figure 19B:
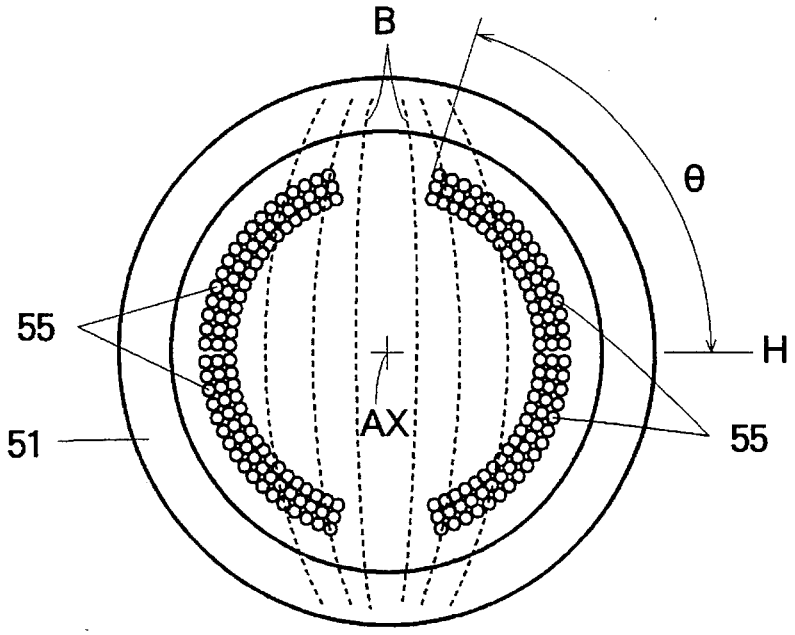
FIG. 19B is an explanatory drawing showing a barrel magnetic field.
Figure 20A:
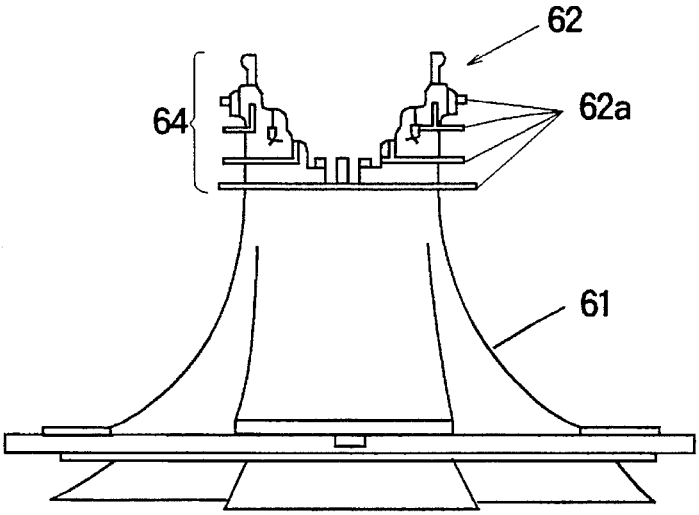
FIG.20A PRIOR ART
FIG. 20A is a Front elevation view of a coil bobbin according to prior art, which is provided with winding hooks in multiple tiers on a virtually hollow funnel-shaped tapered piece capable of adopting the slit-saddle winding method.
Figure 20B:
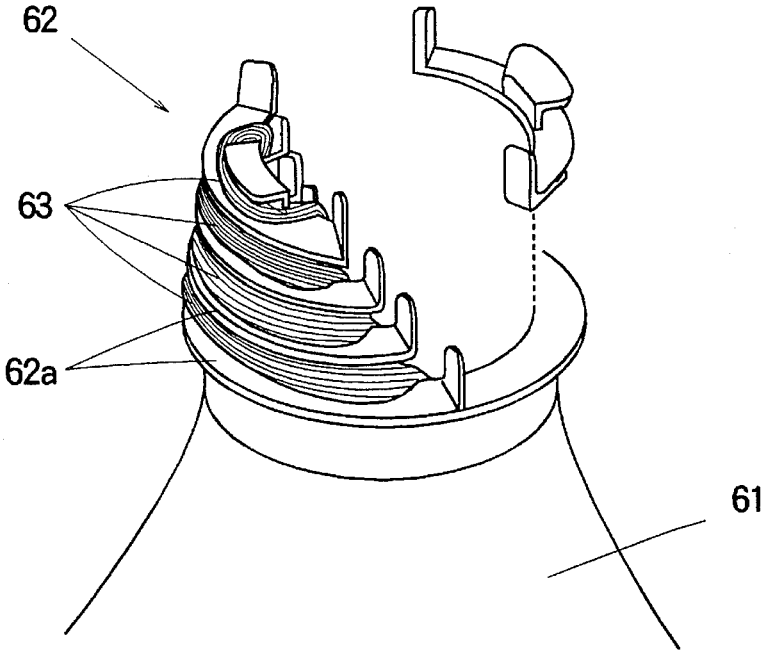
FIG.20B PRIOR ART
FIG. 20B is a perspective view of the detail of the multiple tiers of winding hooks.
Figure 21:
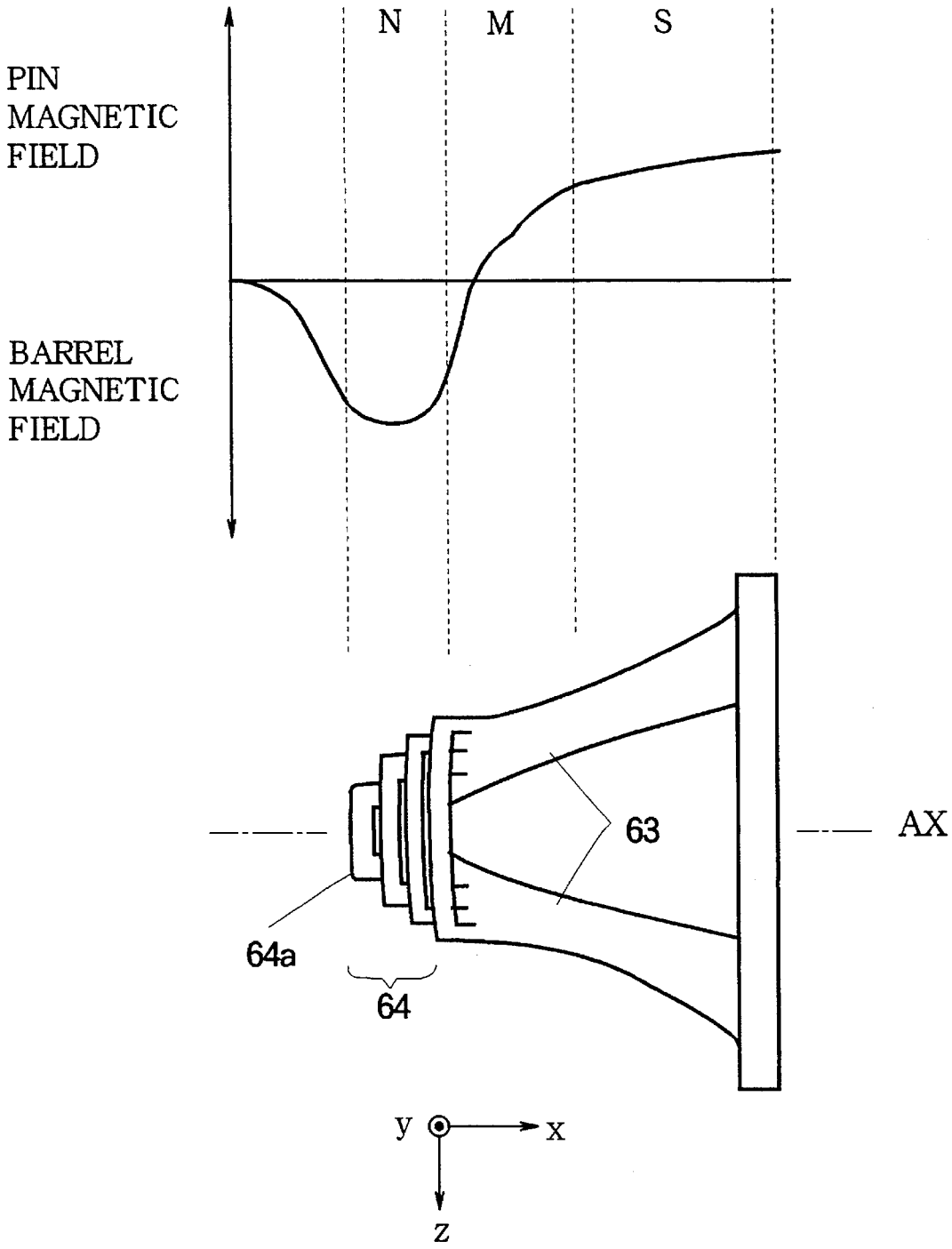
FIG. 21 PRIOR ART
FIG. 21 shows, in its lower portion, a plane view from above the deflection coil when the deflection yoke shown in FIG. 20 is mounted to a CRT, and, in its upper portion, an explanatory drawing showing the deflection magnetic field produced by the deflection coil.

As is shown in FIG. 6, In a deflection yoke according to the first embodiment, the winding bundles 7*a* through 7*e*, which are provided between the small-aperture portion 1*a* and the large-aperture portion 1*b* along the inner surface of the tapered piece 1, are bent at a point between the small-aperture portion 1*a* and the large-aperture portion 1*b*. On the side of the bend 9 that is nearer the large-aperture portion 1*b* (the right side of FIG. 6), the winding angle of the winding bundles 7*a* through 7*e* on a cross-sectional plane perpendicular to the center axis AX (corresponding to angle θ in FIG. 19A), is made smaller, as shown in FIG. 19A. On the side of the bend 9 that is nearer small-aperture portion 1*a* (the left side of FIG. 6), by contrast, the winding angle θ is made larger, as shown in FIG. 19B. Thus in middle region M that lies at the midpoint from the bend 9 toward the small-aperture portion 1*a*, the larger winding angle produces a strong barrel magnetic field, while in screen side region S that lies at the midpoint from the bend 9 toward the large-aperture portion 1*b*, the smaller winding angle produces a strong pin magnetic field. Ideally, on the side between the bend 9 and the small-aperture portion 1*a*, the winding bundles are in such a position that more of the winding angles are greater than 30°, and on the side between the bend 9 and the large-aperture portion 1*b*, the winding bundles are in such a position that more of the winding angles are less than 30°. In the neck side region N shown in FIG. 6, however, the bundles are in a position such that angle θ is greater than 30° and the winding bundle producing the barrel magnetic field (the one on the side designated 7*a*) is folded back at the midpoint of the neck side region N. The outside winding bundle (the one oil the side designated 7*e*) however is in a position where the winding angle is less than 30°, which tend to weaken the barrel magnetic field produced by the winding bundle on the side designated 7*a*, and further is present throughout virtually the whole region up to the end of neck side region N (at the leftmost edge of FIG. 6). Thus, as shown in FIG. 6, it is possible, by means of the deflection yoke according to the first embodiment, to produce a weak barrel magnetic field in neck side region N, a strong barrel magnetic field in middle region M, and a strong pin magnetic field in screen side region S.

As has been described above, through the use of a deflection yoke according to the first embodiment of the present invention, or a coil bobbin constituting such a deflection yoke, the winding bundles wound onto the winding hooks 2 and 3 of the small-aperture portion 1*a* and the large-aperture portion 1*b* of the tapered piece 1 are, as shown in FIG. 4, aligned along the outer surface of the winding hooks 2 and 3, which form a bridging portion of the conductor and do not project beyond the outer surface 1*d* of the tapered piece 1. Thus when an annular core (not shown) is mounted to the outside of the tapered piece 1, it can be mounted by a simple procedure in which it is simply slid over from the small-aperture portion 1*a* side of the tapered piece 1, thereby improving the deflection yoke productivity.

Further, in the deflection yoke according to the first embodiment, the winding hooks 2 and 3 protrude in the direction of the center axis AX of the tapered piece 1 and the winding bundles aligned along the outer surface of the winding hooks 2 and 3 so that a considerably large number of winding turns can be obtained. According it is possible to configure a powerful deflection yoke capable of imparting a sufficiently large angle of deflection to the electron beam that passes from the electron gun (not shown) through the small-aperture portion 1*a* and the large-aperture portion 1*b*.

Further, in the deflection yoke according to the first embodiment, the winding bundles are aligned with the outer surface of the winding hooks 2 and 3, and the winding bundles do not project outward in the radial direction. Thus the annular core (not shown) that is mounted outside the tapered piece 1 can be made sufficiently small. It is thus possible, by means of the deflection yoke according to the first embodiment, to increase deflection efficiency and reduce electric power consumption.

Figure 22:
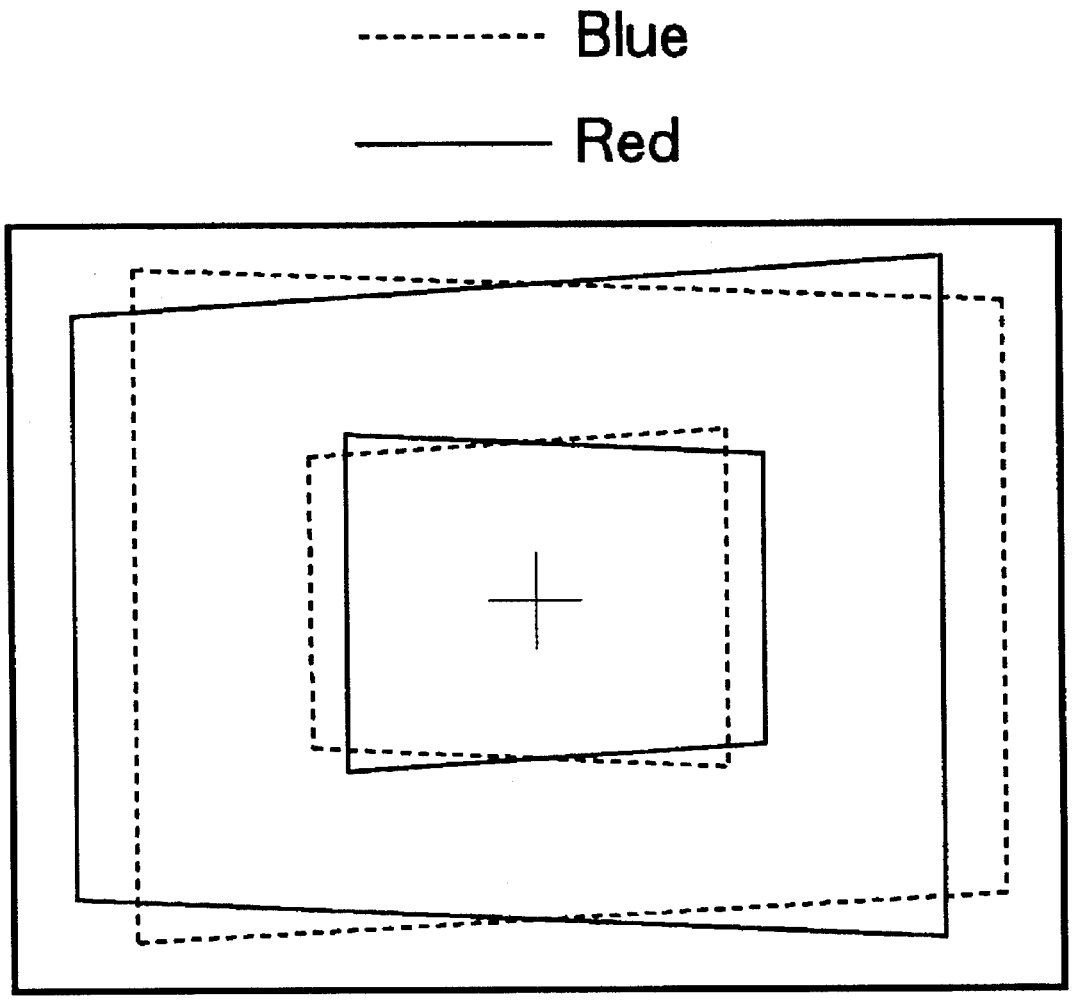
FIG. 22 PRIOR ART
FIG. 22 is an explanatory drawing showing the inverse cross-misconvergence that presents a problem when a deflection yoke according to prior art is used.

Further, in the deflection yoke according to the first embodiment, a winding bundle that is provided along the internal surface 1*c* of the tapered piece 1 between the small-aperture portion 1*a* and the large-aperture portion 1*b* is bent between the small-aperture portion 1*a* and the large-aperture portion 1*b* so that, as a result of the larger winding angle in middle region M between the bend 9 and small-aperture portion 1*a*, a strong barrel magnetic field is produced. Further, as a result of the smaller winding angle in screen side region S between the bend 9 and the large-aperture portion 1*b*, a strong pin magnetic field is produced. Because of this strong barrel magnetic field produced in middle region M and the strong pin magnetic field produced in screen side region S, it is possible to suppress the inverse-cross misconvergence, such as shown in FIG. 22, that occurs with in-line electron guns effectively.

Figure 7:
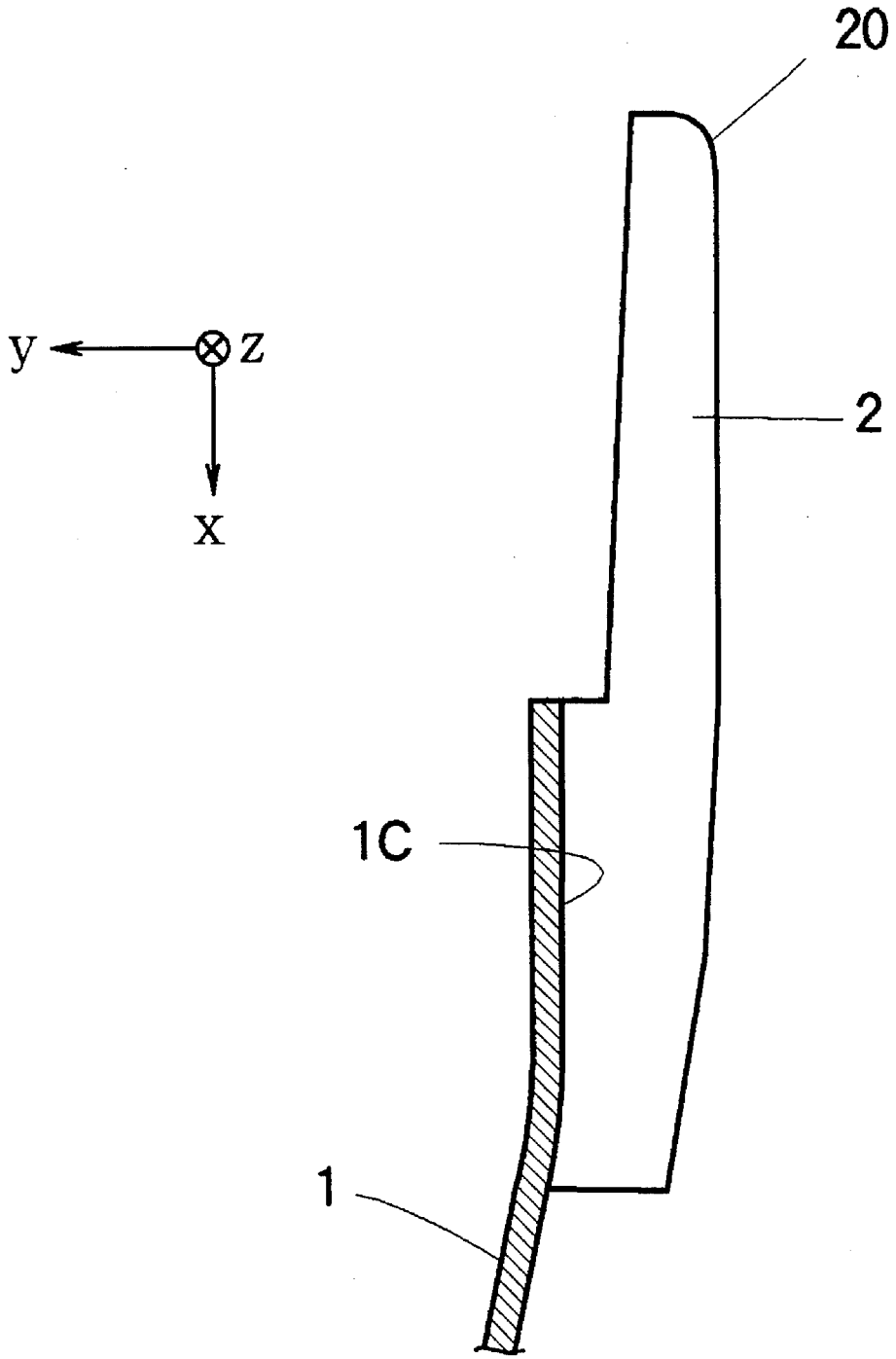
FIG. 7 is a cross sectional view showing an example of a modification of the shape of a winding hook of the deflection yoke according to the first embodiment.

FIG. 7 is a side elevation showing an example of a modification of the shape of a winding hook 2 of a deflection yoke according to the first embodiment. As shown, for example, in FIG. 7, the winding hooks 2 and 3 are thick at the base at which they are affixed to the tapered piece 1 and becoming gradually thinner toward the tip. Furthermore, the angular portion on the inner circumferential side of the individual tips is a chamfer 20 consisting of a curvature. Making the winding hooks 2 and 3 thicker at the base in this way prevents them from bending inward even when they are subjected by the winding bundles 7 and 8 to force acting inward in the radial direction of the tapered piece 1. Further by providing the chamfer 20 on the tips of the inward angles of the winding books 2 and 3, the operation of winding the conductor by means of a winding machine, for example, is facilitated. Further the danger of the conductor becoming caught on the angled tip of winding hooks 2 and 3 is eliminated. Further, by making the base thicker, the inward bending of the winding hooks 2 and 3 is prevented, and since the chamfer 20 is formed on the tips of the inward angles of the winding hooks 2 and 3, the operation when the deflection yoke is fitted over the neck of the CRT can be facilitated.

Figure 8:
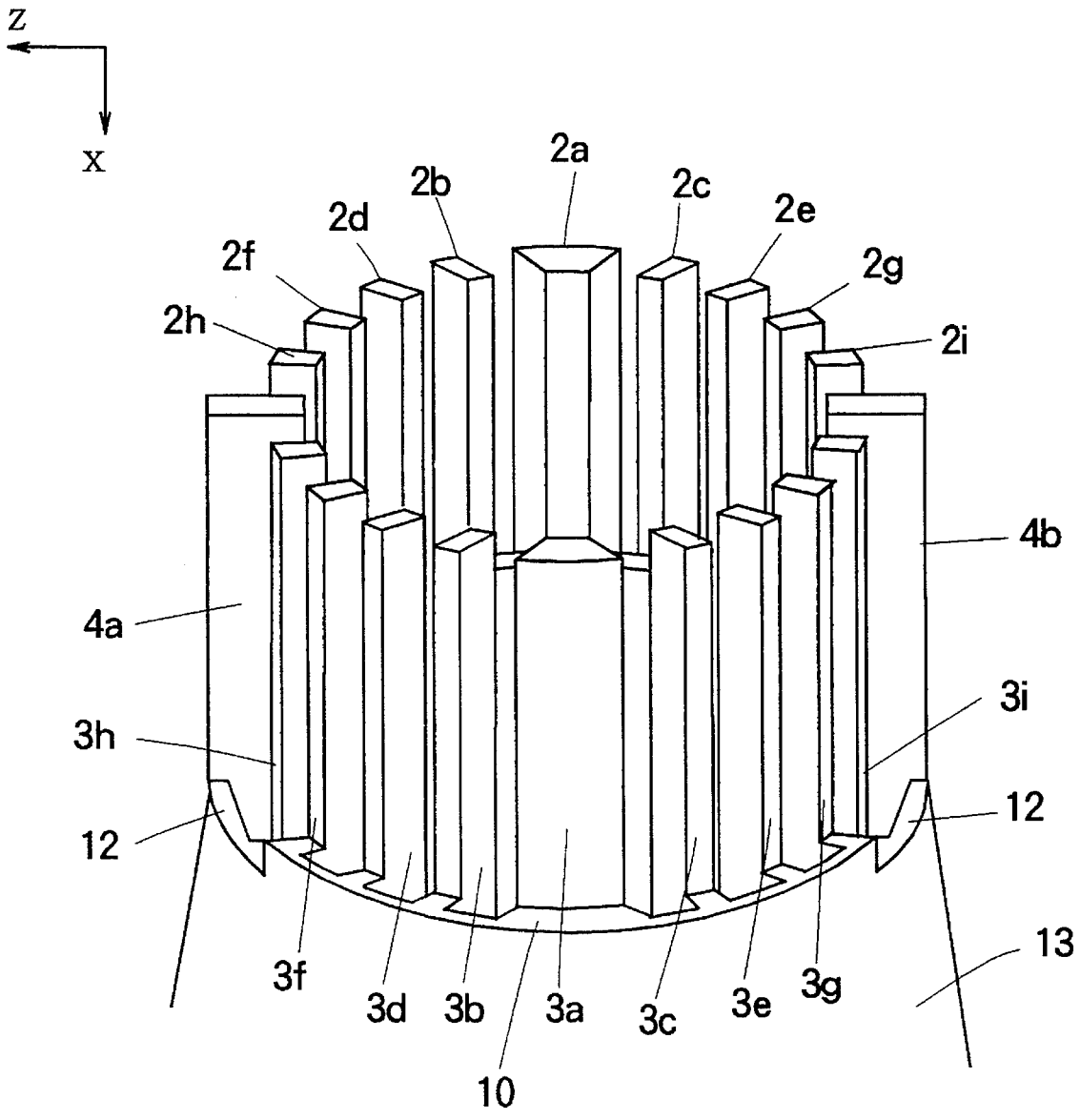
FIG. 8 is a perspective view showing an example of a modification of the shape of the coil bobbin off the deflection yoke according to the first embodiment.

FIG. 8 is a perspective view showing an example of a modification of the shape of the coil bobbin of the deflection yoke according to the first embodiment. In this example, the end 10 of the small-aperture portion of the tapered piece 13 is not flat, the end 10 of FIG. 8 differs from the case shown in FIG. 2 only in that a concavity 12 of a specific depth is formed at the positions adjacent to the separating plates 4*a* and 4*b* respectively. When a conductor is wound onto the tapered piece 13 of FIG. 8, the winding bundle on the small-aperture portion can be wound onto the tapered piece 13 passing through the concavity 12. Thus by suitable selecting the position, width and depth of the concavity 12, adjustments such as shifting the barrel magnetic field in neck side region N shown in FIG. 6 toward the pin magnetic field, strengthening the barrel magnetic field in middle region M, and strengthening the pin magnetic field in screen side region S can be effected.

Note that FIG. 8 shows a case in which the concavity 12 is recessed toward the large-aperture portion, and is formed at the base of the winding hooks 2*h*, 2*i*, 3*h* and 3*i*, which are in closest proximity to the separating plates 4*a* and 5*b*. In order to regulate the magnetic field of the neck side region N and the middle region M, it is equally possible to increase the width of the concavity 12 so that a plurality of the winding hooks 2 and 3 are arranged within the concavity 12 on either side of the separating plates 4*a* and 4*b*.

Figure 9A:
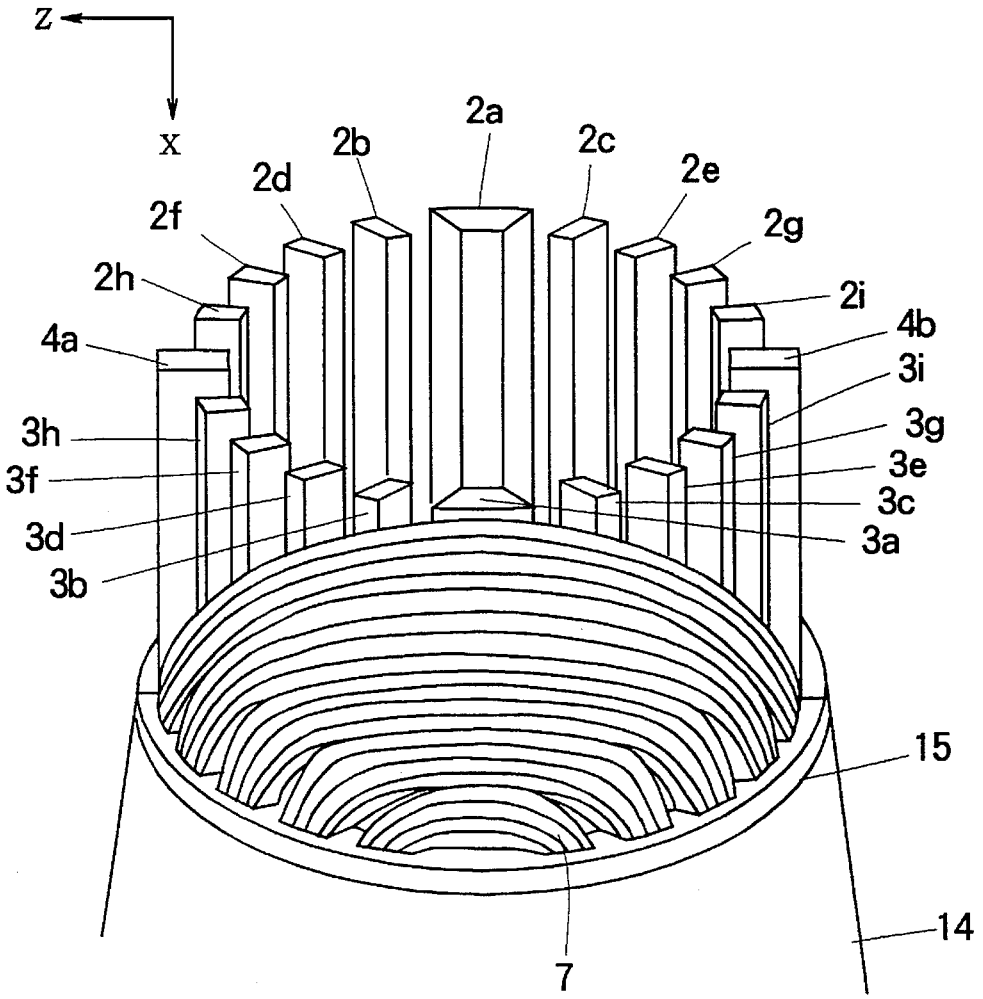
FIG. 9A is a perspective view of the condition in which the coil bobbin of the deflection yoke according to the first embodiment is provided with an annular piece.
Figure 9B:
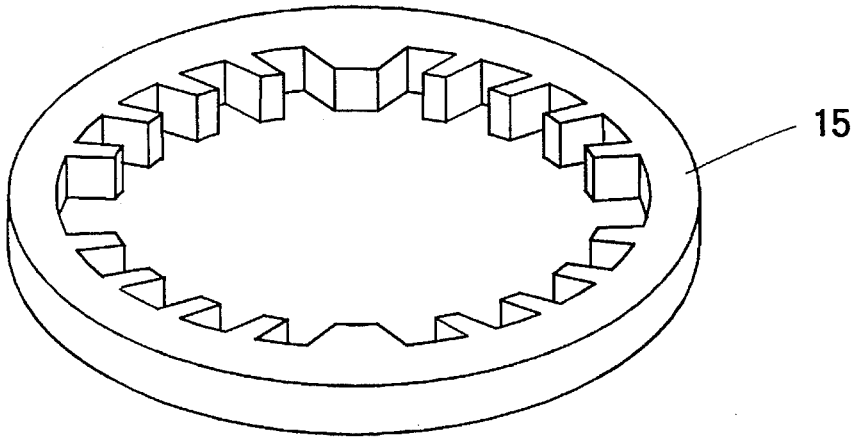
FIG. 9B is a perspective view showing this annular piece.

FIGS. 9A and 9B show a modification of the shape of the deflection yoke shown in FIG. 2. In which FIG. 9A is a perspective view showing an enlargement of the part in question, and FIG. 9B is a perspective view showing a thin sheet annular piece 15 that is mounted to the small-aperture portion of the tapered piece 14. By providing the annular piece 15 on the small-aperture portion of the tapered piece 14, it is possible to change the length of the deflection coil 7, and thereby to manufacture deflection yokes of differing dimensions for use in CRTs of differing size using the same coil bobbin. This makes possible the standardization of the coil bobbins, and by reducing the expense off die-making for the molding of the coil bobbin, makes it possible to reduce the cost of manufacturing the deflection yoke.

Figure 10:
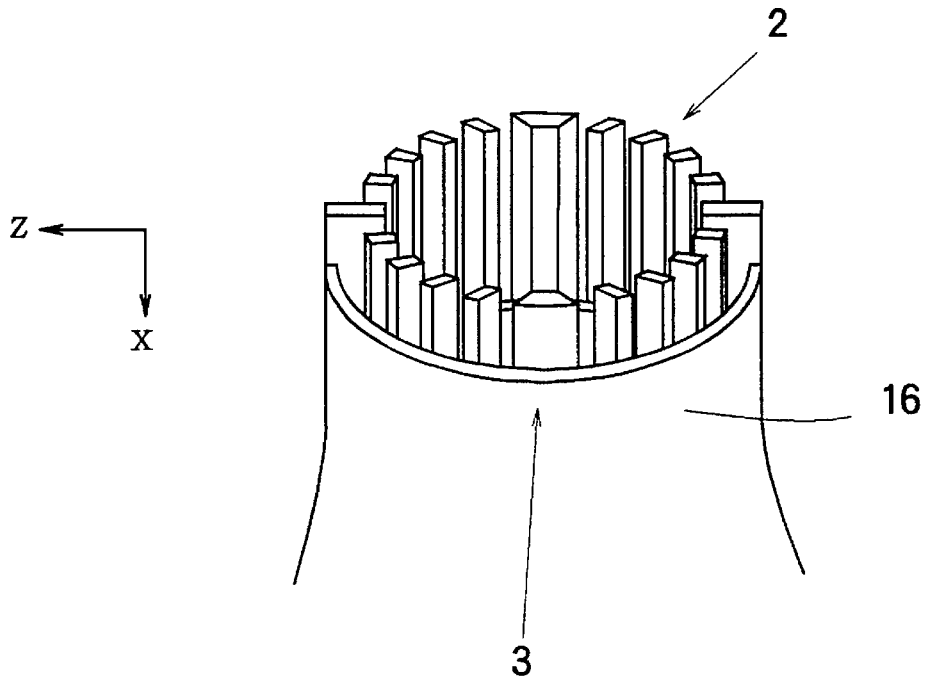
FIG. 10 is a perspective view showing an example of a modification of the shape of the coil bobbin of the deflection yoke according to the first embodiment when provided with a winding guide.

FIG. 10 is a perspective view showing the case in which a cylindrical winding guide 16 is provided on the outside of the coil bobbin shown ill FIG. 2. This winding guide 16 completely eliminates the projection of the conductor at the bridging portion on the winding hooks 2 and 3 that can occur when the conductor is wound onto the coil bobbin using a winding machine (not shown). Further, in this deflection yoke, the winding guide 16 is made lower than the winding hooks 2 and 3, so that the operation of winding the conductor by means of a winding machine, for example, is facilitated, even when a conductor drawn out from the inside of the tapered piece toward the small-aperture portion is threaded onto the winding hooks 2 and 3 by the hook piece of the winding machine on the outside of the tapered piece, thereby improving the ease with which windings are wound and improving deflection yoke productivity. Note that FIG. 10 shows a case in which the coil bobbin and winding guide have been manufactured as a single unit but it is equally possible to make the coil bobbin and winding guide 16 separately and then join them together. It is also possible not to provide winding guide 16 on the coil bobbin, but to hold the coil bobbin stationary during the winding operation by providing a chuck.

Figure 11:
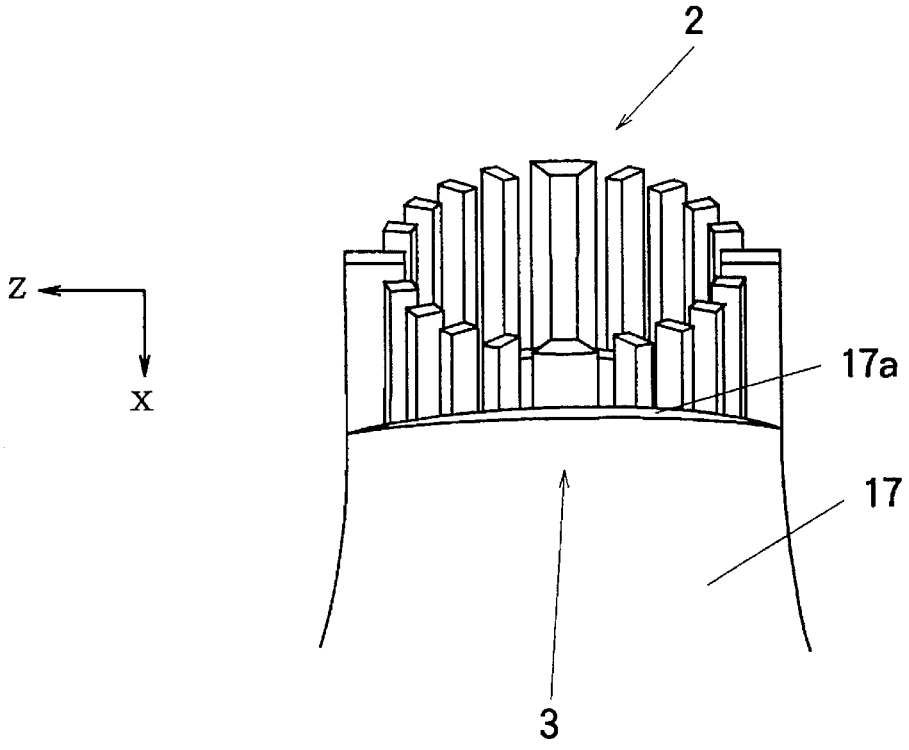
FIG. 11 is a perspective view showing an example of a modification of the shape of the coil bobbin of the deflection yoke according to the first embodiment when provided with a further winding guide.

FIG. 11 is a perspective view showing an example of a winding guide having a shape different from that shown in FIG. 10 provided on the outside of the coil bobbin of FIG. 2. The only difference from FIG. 10 is that the tip of winding guide 17 in FIG. 11 is of an arcuate shape. In the deflection yoke of FIG. 11, the tip 17*a* of winding guide 17 is high in the center, and drops lower toward both sides. The facilitates the threading of a conductor by means of a winding machine, thereby improving the ease with which windings are wound and improving deflection yoke productivity. Further, even if the winding machine is such that the conductor first is threaded onto the winding hooks 2 and 3 and then slide to its base, the conductor can, at the lower positions on winding guide 17, be threaded at a position near the base of winding hook 2 or 3. Thus, the distance that the conductor slides over winding hook 2 or 3 is shortened and damage to the conductor is reduced. In addition, if the tip 17*a* of the winding guide 17 is of an arcuate shape, the damage that may occur to the conductor when it strikes against the tip 17*a* of winding guide 17 is further reduced.

Second Embodiment

Figure 12:
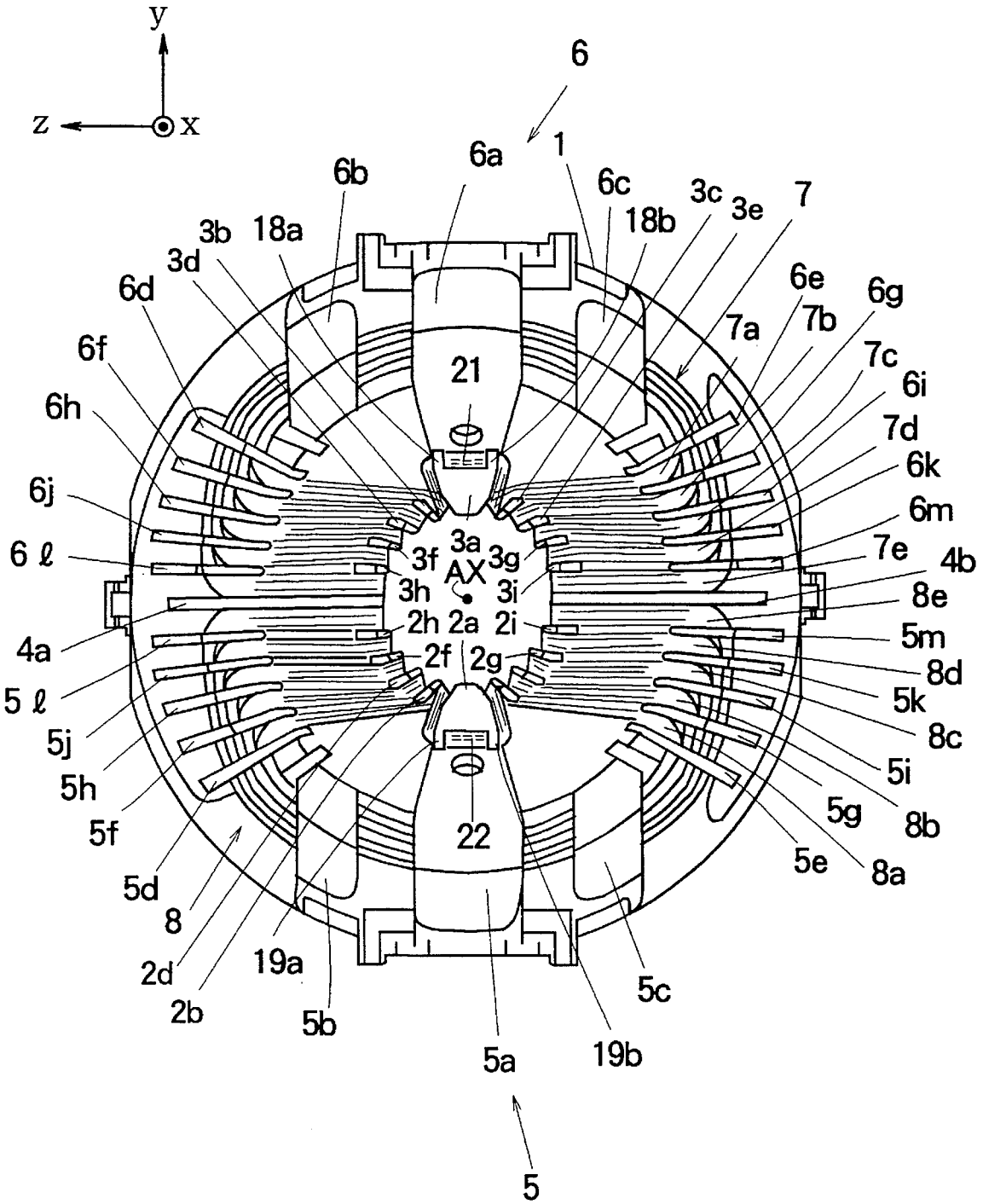
FIG. 12 is a view showing the inner surface of a deflection yoke according to a second embodiment of the present invention as seen from the large-aperture portion.
Figure 13:
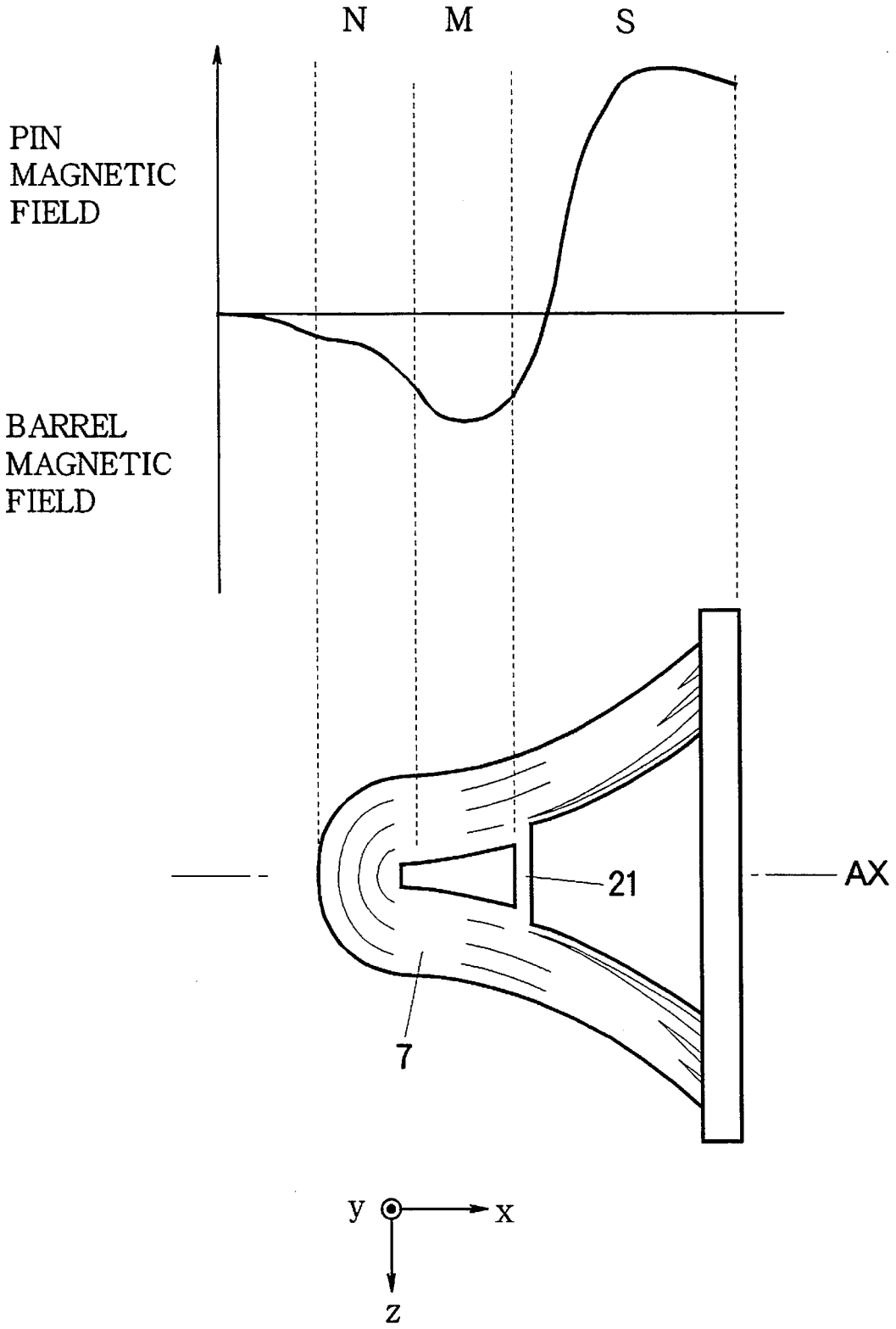
FIG. 13 shows, in its lower portion, a plane view from above a deflection coil showing its condition when the deflection yoke is mounted to a CRT, and, in its upper portion, an explanatory drawing showing the deflection magnetic field produced by the deflection coils.

FIG. 12 is a view showing the inner surface of the tapered piece 1 of a deflection yoke according to a second embodiment of the present invention. FIG. 13 consists, in its lower portion, of a plane view from above deflection coil 7 when the deflection yoke according to the second embodiment is mounted to a CRT, and, in its upper portion, of an explanatory drawing showing the deflection magnetic field produced by deflection coils 7 and 8. Note that in FIG. 12 and FIG. 13, structures identical or analogous to those shown in FIG. 1 through FIG. 11 are designated by the same reference numerals.

As shown in FIG. 12, a deflection yoke according to the second embodiment is provided with winding hooks 18*a* and 18*b*, located on the inner surface of the tapered piece 1 between the winding hook 3*a* on small-aperture portion 1*a*, and the winding hook 6*a* on large-aperture portion 1*b*. This deflection yoke is also provided with winding hooks 19*a* and

19*b*, located on the inner surface of the tapered piece 1 between the winding hook 2*a* on small-aperture portion 1*a*, and the winding hook 5*a* on large-aperture portion 1*b*. It is also provided with a folded winding bundle 21 wound onto the winding hook 3*a* and onto the winding hooks 18*a* and 18*b* in the same direction as the winding bundle 7*a*. Similarly, It is also provided with a folded winding bundle 22 wound onto the winding hook 2*a* and onto the winding hooks 19*a* and 19*b* in the same direction as the winding bundle 8*a*. Note that the number of turns of the folded winding bundles 21 and 22 may be adjusted as required.

In the deflection yoke according to the second embodiment, the folded winding bundles 21 and 22 are provided near the center of the deflection coil so that the barrel magnetic field in the middle region M is strengthened. Thus in the second embodiment, the barrel magnetic field in the middle region M is strengthened by the provision of the folded winding bundles 21 and 22, eliminating the need to provide a deflection coil with a bend at its midpoint, as is the case with a deflection yoke according to the first embodiment. It is, nevertheless, possible to provide the deflection yoke of the second embodiment with a bend, in the same way as in the first embodiment. With the exception of the differences described above, the structure of the deflection yoke of the second embodiment is identical to that of the deflection yoke of the first embodiment, and the effects derived from the deflection yoke of the first embodiment can be similarly derived from the deflection yoke of the second embodiment.

Third Embodiment

Figure 14:
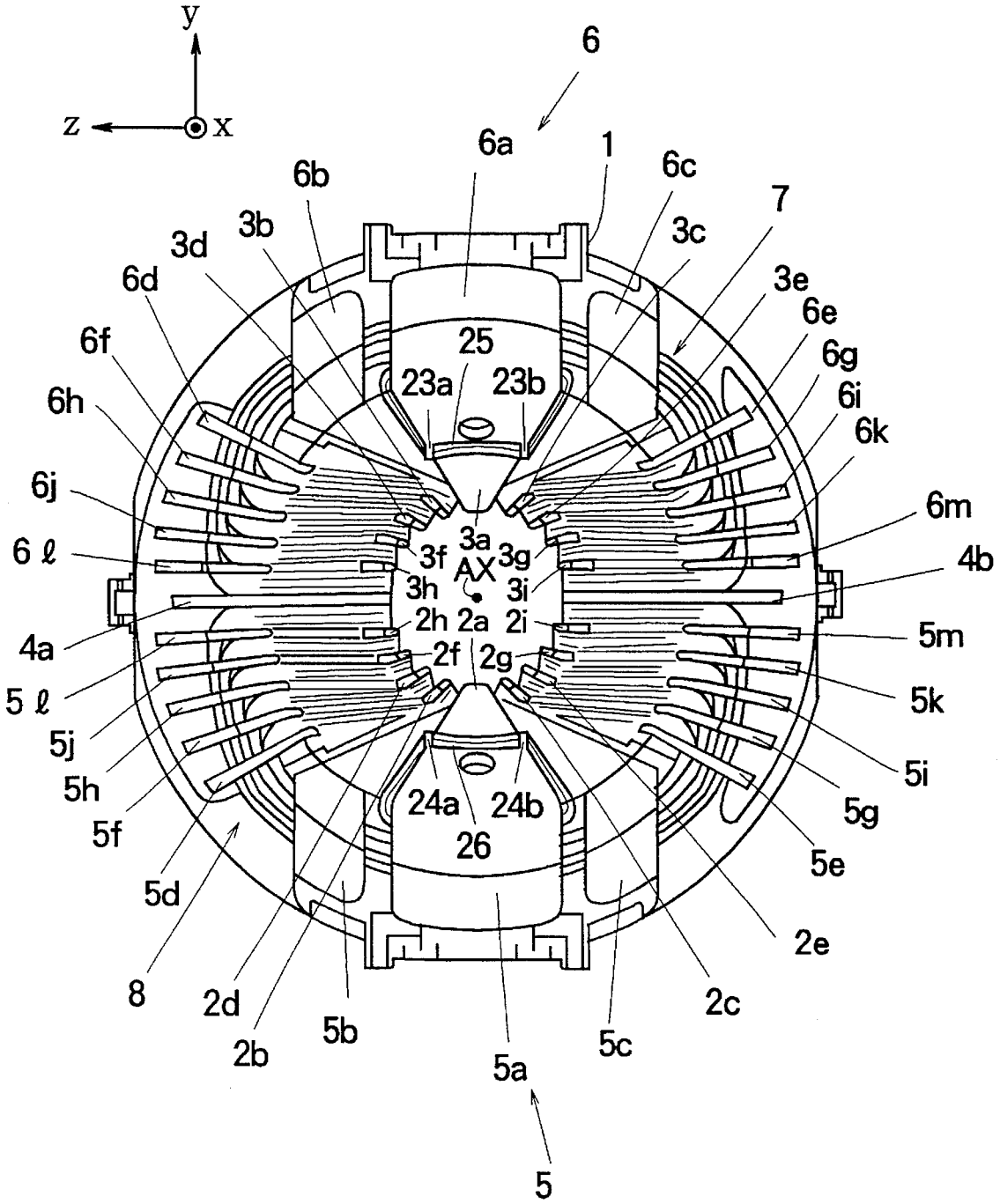
FIG. 14 is a view showing the inner surface of a deflection yoke according to a third embodiment of the present invention as seen from the large-aperture portion.

FIG. 14 is a view showing the inner surface of the tapered piece 1 of a deflection yoke according to a third embodiment of the present invention.

As shown in FIG. 14, a deflection yoke according to the third embodiment is provided with winding hooks 23*a* and 23*b*, located on the inner surface of the tapered piece 1 between the winding hook 3*a* on small-aperture portion 1*a*, and the winding hook 6*a* on large-aperture portion 1*b*. This deflection yoke is also provided with winding hooks 24*a* and 24*b*, located on the inner surface of the tapered piece 1 between the winding book 2*a* on small-aperture portion 1*a*, and the winding hook 5*a* on large-aperture portion 1*b*. It is also provided with a reverse-wound winding bundle 25 wound onto the winding hook 6*a* and onto the winding hooks 23*a* and 23*b* in the direction opposite to that of the winding bundle 7. Similarly, it is also provided with a reverse-wound winding bundle 26 wound onto the winding hook 5*a* and onto the winding hooks 24*a* and 25*b* in the direction opposite to that of the winding bundle 8. The reverse-wound winding bundles 25 and 26 are so positioned that when the deflection yoke is mounted to a CRT, the lines joining the center axis of the tapered piece 1 to the upper end and lower end of the winding bundle forms a winding angle with the horizontal plane of greater than 30°. In this way, the reverse-wound winding bundles 25 and 26 produce a magnetic field in the screen region S that is of opposite polarity to the field produced by the deflection coils 7 and 8. Thus the pin magnetic field in the screen side region S can be strengthened, and inverse-cross misconvergence can be kept small. Further, minute adjustments to the pin magnetic field in screen side region S can be effected by means of the number of turns and winding angle of reverse-wound winding bundles 23 and 24, so that the effect of suppressing the amount of vertical distortion, which presents problems when using, for example, a flat-panel CRT, and the effect that adjustments can be effected in the amount of Sea-gull distortion can be obtained. In the deflection yoke according to the first embodiment, a bend is provided at the midpoint of the deflection coil to strengthen the barrel magnetic field in the middle region M and the pin magnetic field in screen side region S, but in the deflection yoke according to the third embodiment, the winding bundles 21 and 22, which are folded back at the midpoint serve to strengthen the barrel magnetic field at the middle region M, obviating the need for a bend. With the exception of the differences described above, the structure of the deflection yoke of the third embodiment is identical to that of the deflection yoke of the first embodiment, and the effects derived from the deflection yoke of the first embodiment can be similarly derived from the deflection yoke of the third embodiment.

Fourth Embodiment

Figure 15:
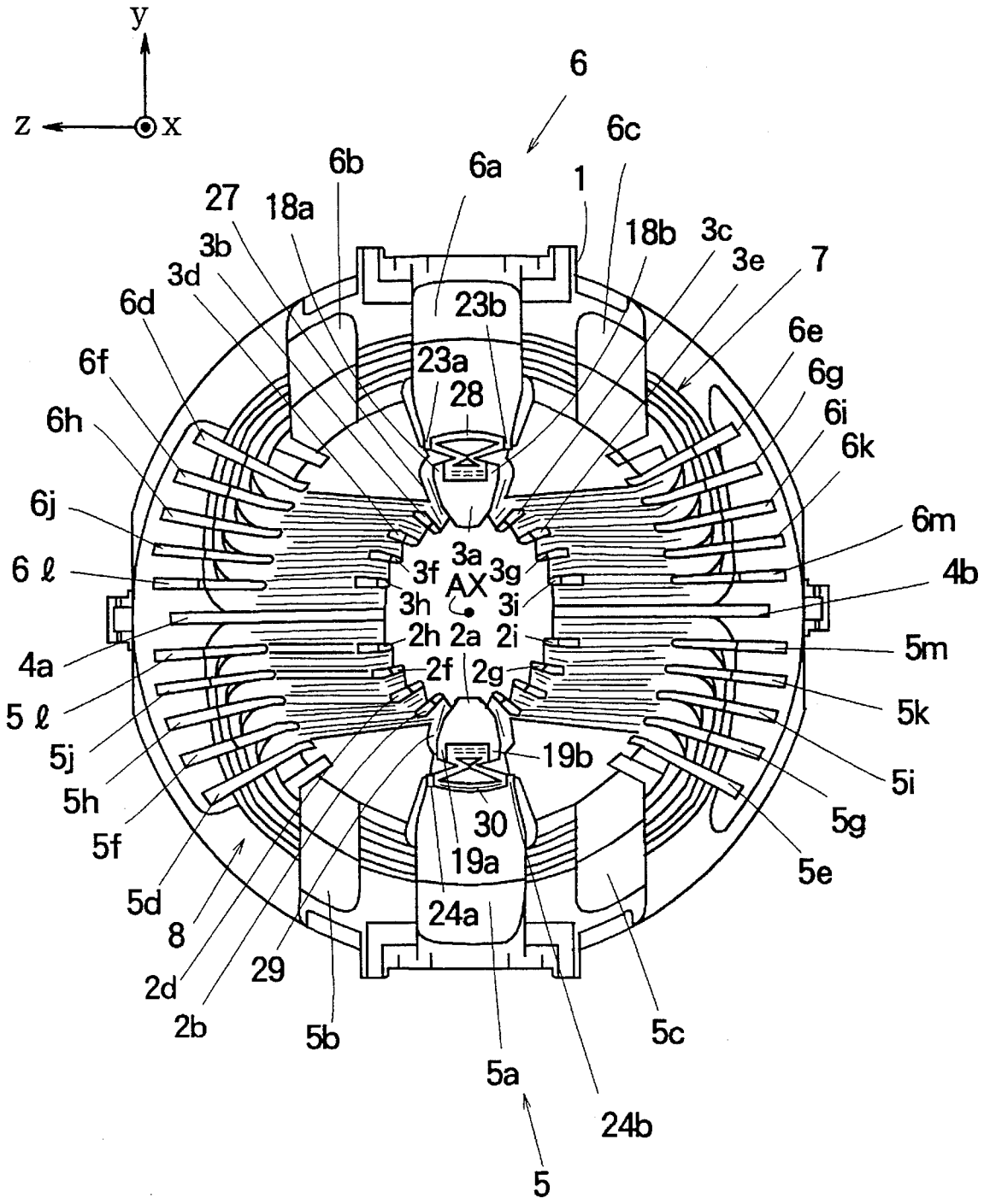
FIG. 15 is a view showing the inner surface of a deflection yoke according to a fourth embodiment of the present invention as seen from the large-aperture portion.

FIG. 15 is a view showing the inner surface of the tapered piece 1 of a deflection yoke according to a fourth embodiment of the present invention.

As shown in FIG. 15, a deflection yoke according to the fourth embodiment is provided with winding hooks 18*a* and 18*b* and winding hooks 23*a* and 23*b*, located on the inner surface of the tapered piece 1 between the winding hook 3*a* on the small-aperture portion 1*a*, and the winding hook 6*a* on the large-aperture portion 1*b*. This deflection yoke is also provided with winding hooks 19*a* and 19*b* and winding hooks 24*a* and 25*b*, located on the inner surface of the tapered piece 1 between the winding hook 5*a* on the small-aperture portion 1*a*, and the winding hook 2*a* on the large-aperture portion 1*b*.

The deflection yoke is also provided with a folded winding bundle 27 wound onto the winding hook 3*a* and onto winding hooks 18*a* and 18*b* in the same direction as the winding bundle 7. A portion of the conductor of folded winding bundle 27 is formed so as to have intersection between the winding hooks 18*a* and 18*b* and the winding hooks 23*a* and 23*b*, and forming, with the winding hooks 23*a* and 23*b* and the winding hook 6*a*, a reverse-wound winding bundle 28, which is wound in a direction opposite to that of the winding bundle 7. The deflection yoke is similarly provided with a folded winding bundle 29 wound onto the winding hook 2*a* and onto the winding hooks 19*a* and 19*b* in the same direction as the winding bundle 8. A portion of the conductor of the folded winding bundle 29 is thus so formed as to have an intersection between the winding hooks 19*a* and 19*b* and the winding hook 24*a* and 25*b*, and forming, with the winding hooks 24*a* and 25*b* and the winding hook 5*a*, a reverse-wound winding bundle 30, which is wound in a direction opposite to that of the winding bundle 8. The reverse-wound winding bundles 28 and 30 are so positioned that, when the deflection yoke is mounted to a CRT, the Nines joining the center axis of the tapered piece 1 to the upper and lower ends of the winding bundle forms a winding angle with the horizontal plane of greater than 30°.

Thus in the deflection yoke according to the fourth embodiment, the provision of the folded winding bundles 21 and 22, which are folded back at the midpoint, serve to strengthen the barrel magnetic field at the middle region M, while at the same time, the reverse-wound winding bundles 25 and 26 produce a magnetic field in the screen side region S that is of opposite polarity to the field produced by the deflection coils 7 and 8. Thus the pin magnetic field in the screen side region S can be strengthened, and inverse-cross misconvergence can be kept even smaller. In the deflection yoke according to the first embodiment, a bend is provided at the midpoint of the deflection coil to strengthen the barrel magnetic field in the middle region M and the pin magnetic field in the screen side region S, but in the deflection yoke according to the fourth embodiment, the folded winding bundles 21 and 22, which are folded back at the midpoint, serve to strengthen the barrel magnetic field at the middle region M, obviating the need for a bend. With the exception of the differences described above, the structure of the deflection yoke of the fourth embodiment is identical to that of the deflection yoke of the first embodiment, and the effects derived from the deflection yoke of the first embodiment can be similarly derived from the deflection yoke of the fourth embodiment.

Fifth Embodiment

Figure 16:
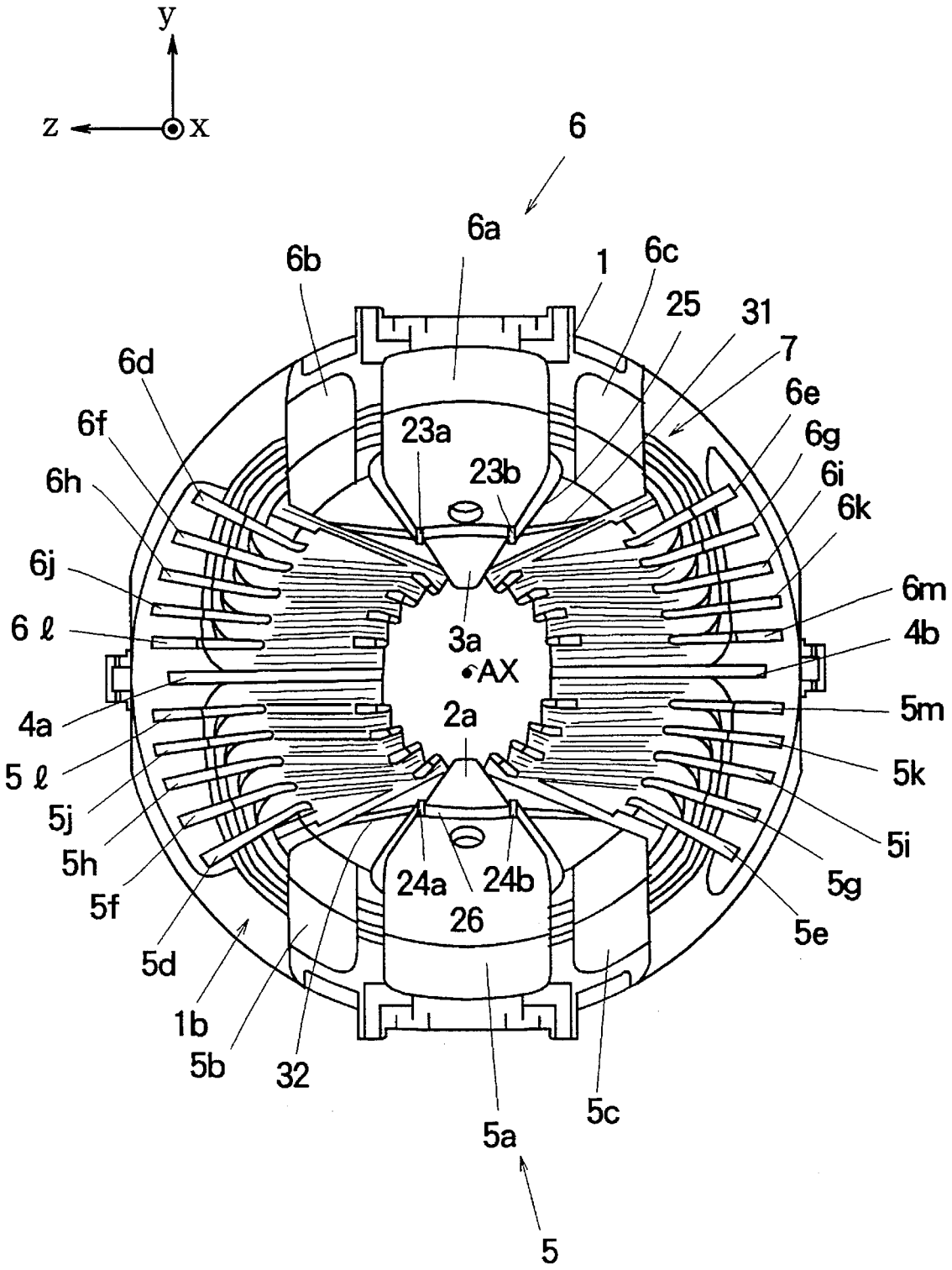
FIG. 16 is a view showing the inner surface of a deflection yoke according to a fifth embodiment of the present invention as seen from the large-aperture portion.
Figure 17A:
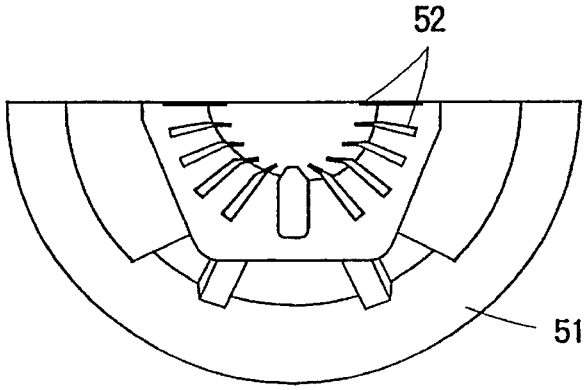
FIG.17A PRIOR ART
FIG. 17A is a top view.
Figure 17B:
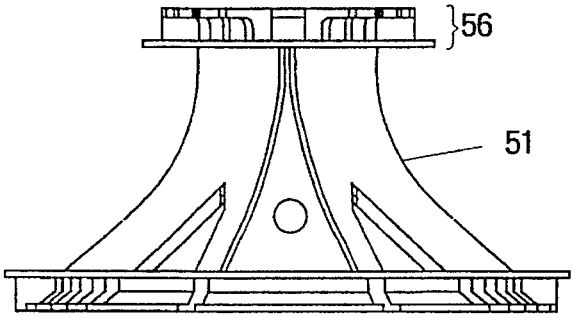
FIG.17B PRIOR ART
FIG. 17B is a front elevation view and FIG. 17C is a bottom view or a coil bobbin according to prior art, which is capable of adopting the slit-saddle winding method.
Figure 17C:
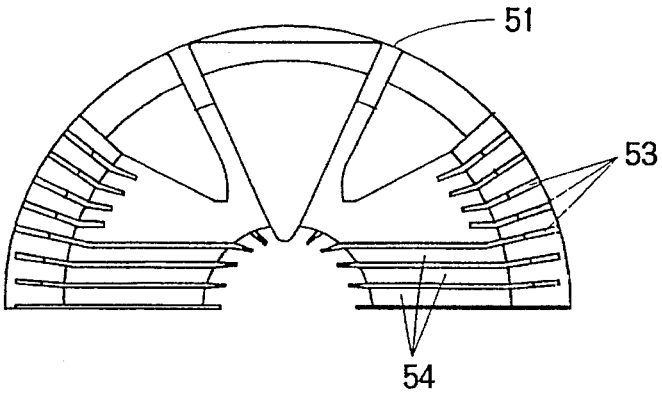
FIG.17C PRIOR ART
Figure 18:
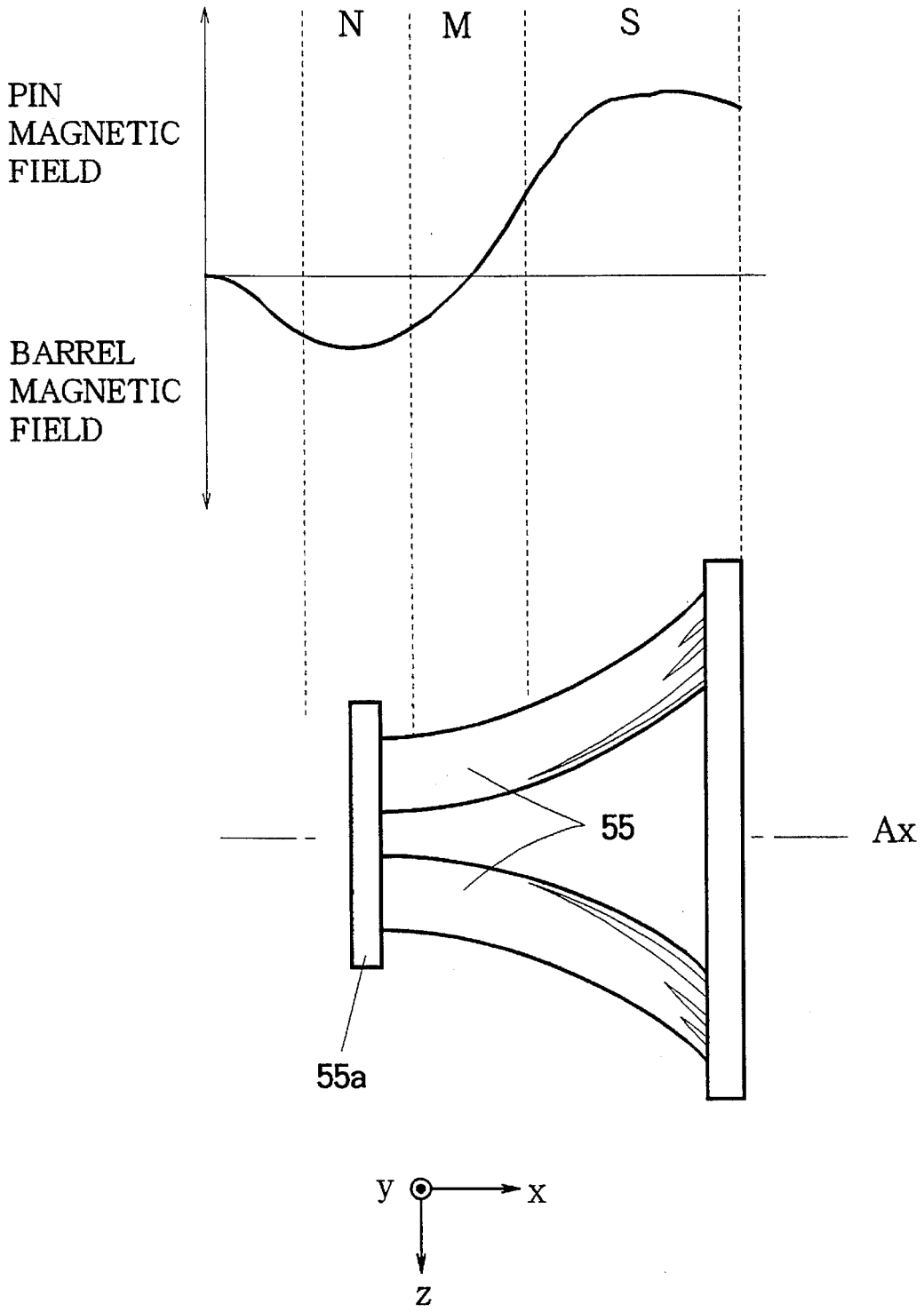
FIG.18 PRIOR ART
FIG. 18 shows, in its lower portion, a plane view from above the deflection coil when the deflection yoke shown in FIG. 17 Is mounted to a CRT, and, in its upper portion, an explanatory drawing showing the deflection magnetic field produced by the deflection coil.

FIG. 16 is a view showing the inner surface of the tapered piece i of a deflection yoke according to a fifth embodiment of the present invention.

A deflection yoke according to the fifth embodiment has, in addition to the structures of the deflection yoke according to the third embodiment shown in FIG. 14, includes a reverse-wound winding bundle 31 wound onto winding hook 3*a* and onto the winding hooks 6*c*, 6*a* and 6*b*, and a reverse-wound winding bundle 32 wound onto the winding hook 2*a* and onto the winding hooks 5*c*, 5*a* and 5*b*. In this way adjustments in the deflection field can be obtained by providing a plurality of reverse-wound winding bundles 25, 26, 31 and 32. With the exception of the differences described above, the structure of the deflection yoke of the fifth embodiment is identical to that of the deflection yoke of the third embodiment shown in FIG. 14, and the effects derived from the deflection yoke of the third embodiment can be similarly derived from the deflection yoke of the fifth embodiment.

What is claimed is:

1. A deflection yoke comprising:

a hollow funnel-shaped tapered piece having a small-aperture portion and a large-aperture portion:

a first set of winding hooks provided on the small-aperture portion of said tapered piece;

a second set of winding hooks provided on the large-aperture portion of said tapered piece; and a deflection coil for producing a magnetic field for deflecting an electron beam which is emitted from an in-line gun of a CRT and proceeds within said tapered piece from said small-aperture portion to said large-aperture portion, said deflection coil comprising a bundle of conductor wound onto said first and second set of winding hooks and disposed along an inner surface of said tapered piece;

wherein said first set of winding hooks protrude in a direction parallel to that of a center axis of said tapered piece; and wherein said deflection coil comprises first through n-th winding bundles, where n is a positive integer equal to or greater than 2; said first winding bundle comprises a bundle of conductor wound for a specific number of turns onto a center winding hook at a center of said first set of winding hooks and onto said second winding hooks; said second winding bundle includes a bundle of conductor wound for a specific number of turns onto said center winding hook at the center of said first set of winding hooks and a first number of winding hooks adjacent to said center winding hook on either side, and onto said second winding hooks; the third and subsequent winding bundles comprise bundles of conductor wound for a specific number of turns onto said center winding hook at the center of said first set of winding hooks and a second number of winding hooks adjacent to said center winding hook on either side, and onto said second winding hooks; and said first through n-th winding bundles are wound onto said first set of winding hooks in a same direction, aligned on said first set of winding hooks, and arranged in an order such that said first winding bundle is closest to an end of said small-aperture portion of said tapered piece and the n-th winding bundle is farthest from said end of said small-aperture portion of said tapered piece, and winding bundles subsequent to said first winding bundle are aligned along a previous winding bundle which is closer to said end of said small-aperture portion of said tapered piece.

2. A deflection yoke of claim 1, wherein, when the deflection yoke is mounted to the CRT, said first set of winding hooks are provided in pairs that face each other across said small-aperture portion of said tapered piece.

3. A deflection yoke of claim 1, wherein said first through n-th winding bundles arranged along the inner surface of said tapered piece bend at a specific point between said small-aperture portion and said large-aperture portion so that a magnetic field produced on said small-aperture portion side of the bend is mainly a barrel magnetic field, and a magnetic field produced on said large-aperture portion side of the bend is mainly a pin magnetic field.

4. A deflection yoke of claim 3, wherein, when the deflection yoke is mounted to the CRT, said first through n-th winding bundles are so arranged that winding angles formed between lines connecting said center axis of said tapered piece and winding coils of said first through n-th winding bundles in a plane perpendicular to said center axis are larger at said small-aperture portion side of the bend in said deflection coil than the winding angles at the large-aperture portion side of the bend in said deflection coil.

5. A deflection yoke of claim 4, wherein said first through n-th winding bundles are so arranged that winding bundles with a winding angle greater than 30° are more numerous than winding bundles with a winding angle less than 30° at said small-aperture portion side of the bend in the deflection coil, and the winding bundles with a winding angle less than 30° are more numerous than the winding bundles with a winding angle greater than 30° at said large-aperture portion side of the bend.

6. A deflection yoke of claim 1, further comprising: a third set of winding hooks disposed on said inner surface of said tapered piece near a midpoint between said small-aperture portion and said large-aperture portion; and a first folded winding bundle being wound on said first set of winding hooks and said third set of winding hooks in the same direction as said first through n-th winding bundles.

7. A deflection yoke of claim 1, further comprising:

a third set of winding hooks disposed on the inner surface of said tapered piece near a midpoint between said small-aperture portion and said large-aperture portion; and a set of reverse-wound winding bundles being wound on said second set of winding hooks and said third set of winding hooks in a direction opposite to that of said first through n-th winding bundles.

8. A deflection yoke of claim 7, wherein said set of reverse-wound winding bundles includes a first reverse-wound winding bundle that is wound onto a winding hook at a center of said second set of winding hooks and onto said third set of winding hooks, and a second reverse-wound winding bundle that is wound onto the winding hook at the center of said second set of winding hooks and winding hooks adjacent thereto and onto said third set of winding hooks.

9. A deflection yoke of claim 7, wherein, when the deflection yoke is mounted to the CRT, said set of reverse-wound winding bundles are arranged in such a way that a winding angle formed between lines connecting said center axis of said tapered piece and winding coils of said set of reverse-wound winding bundles in a plane perpendicular to said center axis is greater than 30°.

10. A deflection yoke of claim 1, further comprising:

a third set of winding hooks disposed on the inner surface of said tapered piece near a midpoint between said small-aperture portion and said large-aperture portion:

a first folded winding bundle being wound onto said first set of winding hooks and said third set of winding hooks in the same direction as said first through n-th winding bundles;

a fourth set of winding hooks disposed on the inner surface of said tapered piece nearer said large-aperture portion than said third set of winding hooks; and a first reverse-wound winding bundle being wound onto said second set of winding hooks and said fourth set of winding hooks in a direction opposite to said first through n-th winding bundle.

11. A deflection yoke of claim 10, wherein, when the deflection yoke is mounted to the CRT, said first reverse-wound winding bundle is arranged in such a way that a winding angle formed between lines connecting said center axis of said tapered piece and winding coils of said first reverse-wound winding bundle in a plane perpendicular to said center axis is greater than 30°.

12. A deflection yoke of claim 10, further comprising:

a conductor wound in the same direction as said first through n-th winding bundles onto said first set of winding hooks and said third set of winding hooks, said conductor being led to said fourth set of winding hooks and wound in the direction opposite to said first through n-th winding bundles onto said fourth set of winding hooks and said second set of winding hooks to form a second folded winding bundle and a second reverse-wound winding bundle.

13. A deflection yoke of claim 12, wherein said conductor substantially forms a figure-eight shape with intersections between said third and fourth sets of winding hooks.

14. A deflection yoke of claim 1, wherein each of said first set of winding hooks extend from said tapered piece and have a tip, and each of said first set of winding hooks is thicker toward said tapered piece and thinner toward the tip.

15. A deflection yoke of claim 1, further comprising a thin annular piece having a same planar shape as a cross-section of said small-aperture portion in a direction perpendicular to said central axis, and said annular piece being provided at said small-aperture portion of said tapered piece.

16. A deflection yoke of claim 1, further comprising a winding guide of virtually cylindrical shape for guiding a conductor wound onto said first set of winding hooks, said winding guide covering said tapered piece and a portion of said first set of winding hooks.

17. A deflection yoke of claim 16, wherein said first set of winding hooks project beyond said winding guide in a direction parallel to said center axis.

18. A deflection yoke of claim 1, wherein said first set of winding hooks extend from said inner surface of said small aperture portion in a direction parallel to said central axis, a portion of each of said first set of winding hooks is disposed on said inner surface of said small aperture portion, and said first through n-th winding bundles are wound on an outer surface of said first set of winding hooks so that an outermost portion of said first through n-th winding bundles is positioned within an outer surface of said tapered piece.

19. A deflection yoke of claim 1, wherein said first set of winding hooks have an inner surface, an outer surface, and a tip, and said inner surface at said tip is chamfered to form a curved surface.

20. A deflection yoke of claim 1, wherein said first set of winding hooks are separated at a first and second position of said small-aperture portion.

21. A deflection yoke of claim 20, wherein said small-aperture portion includes a concave section recessed toward said large-aperture portion, at said first and second positions.

22. A deflection yoke of claim 20, further comprising a winding guide of virtually cylindrical shape for guiding a conductor wound onto said first set of winding hooks, said winding guide covering said tapered piece and a portion of said first set of winding hooks, a portion of said winding guide covering said first set of winding hooks having an arcuate shape with an apex thereof between said first and second position.

* * * * *